United States Patent [19]

Andoh et al.

[11] Patent Number: 4,897,339

[45] Date of Patent: Jan. 30, 1990

[54] METHOD FOR PROCESSING A SILVER HALIDE COLOR PHOTOGRAPHIC MATERIAL AND A COLOR DEVELOPING COMPOSITION COMPRISING HYDROXYLAMINES AND STABILIZING AGENTS

[75] Inventors: Kazuto Andoh; Takatoshi Ishikawa; Morio Yagihara, all of Kanagawa, Japan

[73] Assignee: Fuji Photo Film Co., Ltd., Kanagawa, Japan

[21] Appl. No.: 333,816

[22] Filed: Apr. 6, 1989

Related U.S. Application Data

[63] Continuation of Ser. No. 84,941, Aug. 10, 1987, abandoned.

[30] Foreign Application Priority Data

Aug. 8, 1986 [JP] Japan ..... 61-186560
Sep. 3, 1986 [JP] Japan ..... 61-207545

[51] Int. Cl.[4] ..... G03C 7/30; G03C 5/24

[52] U.S. Cl. ..... 430/372; 430/380; 430/434; 430/464; 430/467; 430/484; 430/486; 430/489; 430/490

[58] Field of Search ..... 430/372, 377, 380, 434, 430/464, 467, 484, 486, 489, 490

[56] References Cited

U.S. PATENT DOCUMENTS

| | | | |
|---|---|---|---|
| 2,875,049 | 2/1959 | Kridel | 430/490 |
| 3,287,125 | 11/1966 | Green | 430/484 |
| 3,293,034 | 12/1966 | Green | 430/484 |
| 3,462,269 | 8/1969 | Tassone | 430/490 |
| 3,996,054 | 12/1976 | Santemma et al. | 430/490 |
| 4,252,892 | 2/1981 | Case | 430/467 |
| 4,482,626 | 11/1984 | Twist et al. | 430/467 |

FOREIGN PATENT DOCUMENTS

| | | | |
|---|---|---|---|
| 0093002 | 11/1983 | European Pat. Off. . | |
| 0231870 | 8/1987 | European Pat. Off. . | |
| 1256540 | 12/1967 | Fed. Rep. of Germany | 430/484 |
| 158446 | 9/1985 | Japan . | |
| 1080016 | 8/1967 | United Kingdom . | |

OTHER PUBLICATIONS

Patent Abstracts of Japan, vol. 4, No. 103, p. 120.
Patent Abstracts of Japan, vol. 10, No. 210, p. 479.

*Primary Examiner*—Paul R. Michl
*Assistant Examiner*—Patrick Doody
*Attorney, Agent, or Firm*—Sughrue, Mion, Zinn, Macpeak & Seas

[57] ABSTRACT

A method for processing a silver halide color photographic material including a step of developing the material with a developer containing an aromatic primary amine color developing agent and at least one compounds represented by the following general formulae (Ia) and (Ib):

(Ia)

wherein $R^1$, $R^2$, $R^3$ and $R^4$, which may be the same or different, each represents a hydrogen atom or an unsubstituted alkyl group; $R^5$, $R^6$ and $R^7$, which may be the same or different, each represents an unsubstituted alkylene group; $X^1$ and $X^2$, which may be the same or different, each represents —O—, —S—, —CO—, $—SO_2$ or —SO—, or a combination thereof, and $R^8$ represents a hydrogen atom or an unsubstituted alkyl group; and m and n, which may be the same or different, each is 0, 1, 2 or 3; and (Ib)

wherein $R^{13}$ represents a substituted alkylene group; and $R^9$, $R^{10}$, $R^{11}$ and $R^{12}$, which may be the same or different, each represents a hydrogen atom, a substituted or unsubstituted alkyl group or a substituted or unsubstituted aryl group. The developer has superior stability and reduces fogging in continuous processing.

26 Claims, No Drawings

METHOD FOR PROCESSING A SILVER HALIDE COLOR PHOTOGRAPHIC MATERIAL AND A COLOR DEVELOPING COMPOSITION COMPRISING HYDROXYLAMINES AND STABILIZING AGENTS

This is a continuation, of application Ser. No. 07/084,941, filed 8/10/87, now abandoned.

FIELD OF THE INVENTION

The present invention relates to a method for processing silver halide color photographic materials, particularly a method for processing silver halide color photographic materials using a color developing solution with improved stability and color formation properties that remarkably limits the increase in fogging in continuous processing.

BACKGROUND OF THE INVENTION

Color photographic developing solutions containing aromatic primary amine color developing agents have long been conventionally used in the formation of color images, and now have a major role in the color photographic image formation process. However, it is well known that conventional color developing solutions are easily oxidized by air or metals, and that if the developing solutions thus oxidized are used to form a color image, fogging increases, sensitivity or gradation changes, and therefore photographic characteristics are adversely affected.

Therefore, various measures to improve the preservability of color developing solutions have been studied, and use of a combination of hydroxylamine and a sulfite ion is the most general current practice. However, when hydroxylamine decomposes, ammonia is released, which causes fogging, and a sulfite ion acts as a competing compound against developing agents, for example, to disadvantageously reduce their color formation capability, so that neither is a preferred preservative.

Particularly, although a sulfite ion has been used as a compound to improve the preservability of various developing agents or to prevent decomposition of hydroxylamine, it greatly impedes color development, and when it is used in a system without benzyl alcohol (which is disadvantageous from the point of view of environmental pollution and preparation of a developing solution), the developed color density is significantly lowered.

Alkanolamines described in Japanese patent application (OPI) No. 3532/79 (corresponding to U.S. Pat. No. 4,170,478) (the term "OPI" as used herein refers to a "published unexamined Japanese patent application") and polyethyleneimines described in Japanese Patent Application (OPI) No. 94349/81 (corresponding to U.S. Pat. No. 4,252,892) are suggested as compounds that can be substituted for sulfites, but these compounds remain unsatisfactory.

Conventionally, to improve the stability of color developing solutions, various preservatives and chelating agents have been studied. For example, preservatives include aromatic polyhydroxy compounds described in Japanese patent application (OPI) Nos. 49828/77, 160142/84 and 47038/81 (corresponding to U.S. Pat. No. 4,264,716) and U.S. Pat. No. 3,746,544; hydroxycarbonyl compounds described in U.S. Pat. No. 3,615,503 and British Pat. No. 1,306,176; α-aminocarbonyl compounds described in Japanese patent application (OPI) Nos. 143020/77 (corresponding to U.S. Pat. No. 4,155,764) and 89425/78; metal salts described in Japanese Patent Application (OPI) Nos. 44148/82 (corresponding to U.S. Pat. No. 4,330,616) and 53749/82; and hydroxamic acids described in Japanese patent application (OPI) No. 27638/77 (corresponding to U.S. Pat. No. 4,055,426). Chelating agents include aminopolycarboxylic acids described in Japanese Patent Publication Nos. 030496/73 and 30232/69 (corresponding to U.S. Pat. No. 3,462,269); organic phosphonic acids described in Japanese Patent Application (OPI) No. 97347/81, Japanese Patent Publication No. 39359/81 (corresponding to U.S. Pat. No. 3,794,591) and West German Patent 2,227,639; phosphonocarboxylic acids described, for example, in Japanese Patent Application (OPI) Nos. 102726/77 (corresponding to U.S. Pat. No. 4,083,723), 42730/78, 121127/79, 126241/80 and 65956/80 and compounds described, for example, in Japanese patent application (OPI) Nos. 195845/83 (corresponding to U.S. Pat. No. 4,482,626) and 203440/83 and Japanese Patent Publication No. 40900/78.

However, even if these techniques are used, preservative performance is inadequate, or photographic characteristics are adversely affected, so that satisfactory results have not yet been attained, and excellent preservatives that can be substituted for sulfites are still keenly sought.

In the case of color photographic materials containing a silver chlorobromide emulsion with a high chlorine content, fogging is liable to occur during color development as described in Japanese patent application (OPI) Nos. 95345/83 and 232342/84. When such an emulsion is used, it is essential to use a preservative that dissolves the emulsion to a reduced extent and has better preservability, and satisfactory preservatives from this viewpoint have not been found.

SUMMARY OF THE INVENTION

Therefore, an object of the invention is to provide a method for processing a silver halide color photographic material using a color developing solution that is excellent in stability and that remarkably limits increase in fogging in continuous processing.

Still further, an object of the present invention is to provide a method for processing silver halide color photographic materials that is excellent in color formation property even by processing the silver halide color photographic materials with a color developing solution substantially free from benzyl alcohol.

It has now been discovered that these and other objects of the invention are attained by a method for processing a silver halide color photographic material including the step of developing a silver halide color photographic material with a developing solution containing an aromatic primary amine color developing agent and at least one compound represented by the following general formulae (Ia) and (Ib):

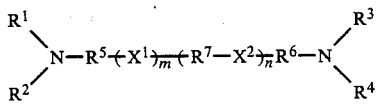

(Ia)

wherein $R^1$, $R^2$, $R^3$ and $R^4$, which may be the same or different, each represents a hydrogen atom or an unsubstituted alkyl group; $R^5$, $R^6$ and $R^7$, which may be the same or different, each represents an unsubstituted alkylene group; $X^1$ and $X^2$, which may be the same or different, each represents

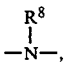

—O—, —S—, —CO—, —$SO_2$— —SO—, or a combination thereof and $R^8$ represents a hydrogen atom or an unsubstituted alkyl group; and m and n, which may be the same or different, each is 0, 1, 2 or 3; and

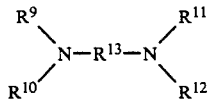

(Ib)

wherein $R^{13}$ represents a substituted alkylene group; and $R^9$, $R^{10}$, $R^{11}$ and $R^{12}$, which may be the same or different, each represents a hydrogen atom, a substituted or unsubstituted alkyl group or a substituted or unsubstituted aryl group.

DETAILED DESCRIPTION OF THE INVENTION

The compounds represented by general formula (I) are now described in detail.

$R^1$, $R^2$, $R^3$ and $R^4$ and each represents a hydrogen atom or an unsubstituted alkyl group; $R^5$, $R^6$ and $R^7$ each represents an unsubstituted alkylene group; $X^1$ and $X^2$ each represents

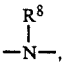

—O—, —S—, —CO—, —$SO_2$—, —SO— or a linking group made up of a combination of these, in which $R^8$ represents a hydrogen atom or an unsubstituted alkyl group; and m and n each is 0, 1, 2 or 3, with 0 or 1 being preferred for both.

The unsubstituted alkyl groups represented by $R^1$, $R^2$, $R^3$, $R^4$ and $R^8$ may be linear, branched or cyclic, and contain 1 to 10 carbon atoms, preferably 1 to 6 carbon atoms. Specific examples of the unsubstituted alkyl groups include a methyl group, an ethyl group, an n-propyl group, an isopropyl group, an n-butyl group, an n-hexyl group, a t-amyl group and a cyclohexyl group.

The unsubstituted alkylene groups represented by $R^5$, $R^6$ and $R^7$ may be linear or branched, and contain 1 to 6 carbon atoms. Specific examples include a methylene group, a dimethylene group, a trimethylene group, a dimethyldimethylene group, a tetramethylene group and a heptamethylene group.

The linking groups represented by $X^1$ and $X^2$ are preferably

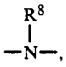

—O— and —S—, particularly preferably

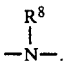

$R^1$, $R^2$, $R^3$, $R^4$ and $R^8$ may be the same or different and $R^5$, $R^6$ and $R^7$ may be the same or different.

The compounds represented by general formula (Ib) are now described in more detail.

In general formula (Ib), $R^{13}$ represents a linear or branched alkylene group having 1 to 30 carbon atoms and being substituted by at least one of a hydroxyl group, an alkoxy group having 1 to 30 carbon atoms, an aryloxy group having 6 to 30 carbon atoms, an amino group, a sulfo group, a phosphonic acid group, a sulfonyl group, a ureido group, an acyl group having 1 to 30 carbon atoms, an alkylthio group having 1 to 30 carbon atoms, an arylthio group having 6 to 30 carbon atoms, a carbamoyl group, a sulfamoyl group, an acylamino group having 1 to 30 carbon atoms, a sulfonamido group having 1 to 30 carbon atoms, a halogen atom, a cyano group and a nitro group. Examples of the alkylene groups represented by $R^{13}$ are a 2-hydroxytrimethylene group and a 1-methoxypentamethylene group. $R^9$, $R^{10}$, $R^{11}$ and $R^{12}$ may be the same or different, and each represents a hydrogen atom, a substituted or unsubstituted alkyl group having 1 to 30 carbon atoms or a substituted or unsubstituted aryl group having 6 to 30 carbon atoms. Preferably the substituents of the substituted alkyl group or the substituted aryl group are a hydroxyl group, an alkoxy group having 1 to 30 carbon atoms, an aryloxy group having 6 to 30 carbon atoms, a carbamoyl group having 1 to 30 carbon atoms, an amino group, a sulfo group, a phosphonic acid group, a sulfonyl group, a ureido group, an acyl group having 1 to 30 carbon atoms, an alkylthio group having 1 to 30 carbon atoms, an arylthio group having 6 to 30 carbon atoms, a carbamoyl group, a sulfamoyl group, an acylamino group having 1 to 30 carbon atoms, a sulfonamido group, a halogen atom, a cyano group and a nitro group. Two or more kinds of or two or more substituents may be present on the alkyl group or the aryl group. Of the functional groups in these substituents, the carboxyl group, the phosphonic acid group and the sulfo group may form a salt with an alkali metal (e.g., sodium and potassium), or may form a salt of positive elements (e.g., $NH_4^+$, $CA^{++}$, etc.), and an amino group may form a salt with an acid such as a hydrochloric acid, a sulfuric acid, a nitric acid, a phosphoric acid, an oxalic acid, an acetic acid, etc.

In general formula (Ib), preferably $R^{13}$ represents a hydroxy-substituted alkylene group, an alkoxy-substituted alkylene group, an amino-substituted alkylene group, a sulfo-substituted alkylene group and a ureido-substituted alkylene group. Preferably, $R^9$, $R^{10}$, $R^{11}$ and $R^{12}$ each represents a hydrogen atom, an unsubstituted alkyl group (e.g., a methyl group, an ethyl group and an isopropyl group), a hydroxy-substituted alkyl group, an alkoxy-substituted alkyl group, a carboxy-substituted alkyl group or a sulfo-substituted alkyl group.

Generally, it is preferred that the sum of the carbon numbers of $R^{13}$, $R^9$, $R^{10}$, $R^{11}$ and $R^{12}$ in general formula (Ib) be 30 or below, and more preferably 20 or below, and most preferably 10 or below.

Specific examples of the compounds represented by general formulae (Ia) and (Ib) are given below, but the present invention is not to be construed as being limited to these compounds.

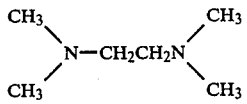
(Ia)-1
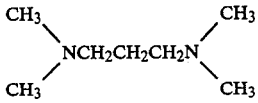
(Ia)-2
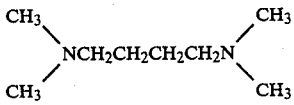
(Ia)-3
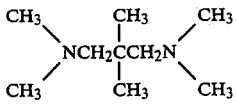
(Ia)-4
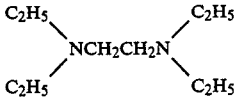
(Ia)-5
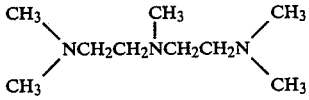
(Ia)-6
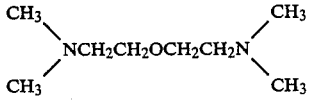
(Ia)-7
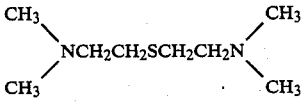
(Ia)-8
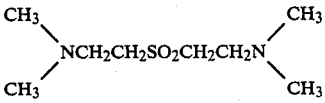
(Ia)-9
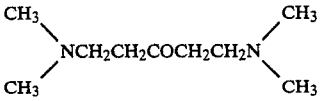
(Ia)-10
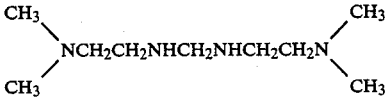
(Ia)-11
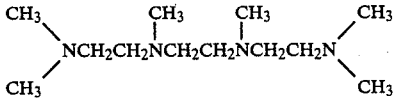
(Ia)-12
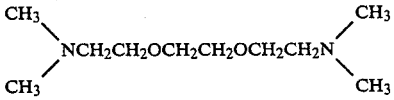
(Ia)-13
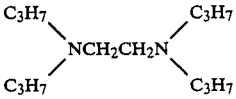
(Ia)-14
-continued
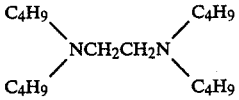
(Ia)-15
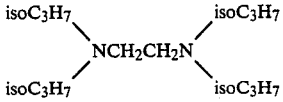
(Ia)-16
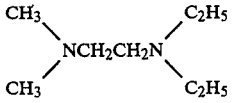
(Ia)-17
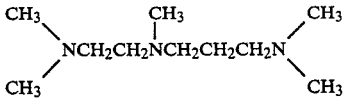
(Ia)-18
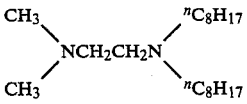
(Ia)-19
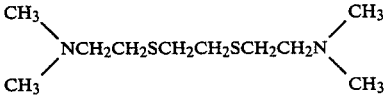
(Ia)-20
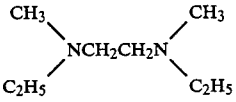
(Ia)-21
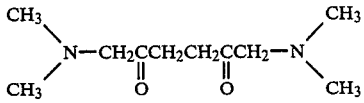
(Ia)-22
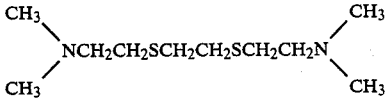
(Ia)-23
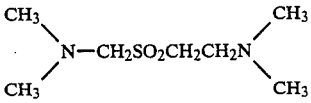
(Ia)-24
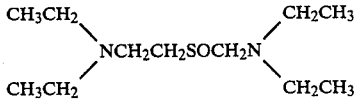
(Ia)-25
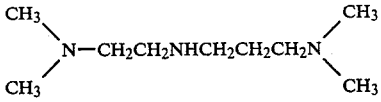
(Ia)-26
$H_2NCH_2CH_2NH_2$ (Ia)-27
$H_2NCH_2CH_2CH_2NH_2$ (Ia)-28
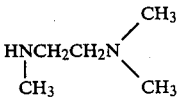
(Ia)-29
$H_2NCH_2CH_2NCH_2CH_2NH_2$
H (Ia)-30

-continued $H_2NCH_2CH_2\underset{H}{N}CH_2CH_2\underset{H}{N}CH_2CH_2NH_2$ (Ia)-31

$H_2NCH_2CH_2\underset{H}{N}CH_2CH_2\underset{H}{N}CH_2CH_2\underset{H}{N}CH_2CH_2NH_2$ (Ia)-32

$H_2NCH_2CH_2\underset{\underset{CH_3}{|}}{N}CH_2CH_2NH_2$ (Ia)-33

$CH_3NHCH_2CH_2NHCH_2CH_2NH_2$ (Ia)-34

$CH_3NHCH_2CH_2NHCH_3$ (Ia)-35

$CH_2\underset{\underset{CH_3}{|}}{N}CH_2CH_2NH_2$ (Ia)-36

$C_2H_5\underset{H}{N}CH_2CH_2\underset{H}{N}C_2H_5$ (Ia)-37

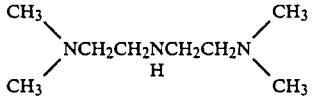
(Ia)-38

$H_2NCH_2CH_2\underset{\underset{CH_3}{|}}{N}CH_2CH_2\underset{\underset{CH_3}{|}}{N}CH_2CH_2NH_2$ (Ia)-39

$C_6H_{13}NHCH_2CH_2NH_2$ (Ia)-40

$H_2N-CH_2\overset{\overset{OH}{|}}{C}HCH_2-NH_2$ (Ib)-1

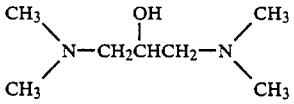
(Ib)-2

$H_2N-(CH_2)_3-\overset{\overset{CH_2OH}{|}}{C}H-NH_2$ (Ib)-3

$H_2N-(CH_2)_4-\overset{\overset{CH_2OH}{|}}{C}H-NH_2$ (Ib)-4

$(HOCH_2CH_2)_2\overset{\overset{OH}{|}}{C}HCH_2N(CH_2CH_2OH)_2$ (Ib)-5

$(HOCH_2CH_2)_2N(CH_2)_4-\overset{\overset{CH_2OH}{|}}{C}H-N(CH_2CH_2OH)_2$ (Ib)-6

$(HO_2CCH_2)_2\overset{\overset{OH}{|}}{C}HCH_2N(CH_2CO_2H)_2$ (Ib)-7

$HO_2CCH_2NHCH_2\overset{\overset{OH}{|}}{C}HCH_2NHCH_2CO_2H$ (Ib)-8

$NaO_2C-\underset{\underset{NaO_2C-CH_2}{|}}{C}H-NHCH_2\overset{\overset{OH}{|}}{C}HCH_2NH-\underset{\underset{CH_2CO_2Na}{|}}{C}HCO_2Na$ (Ib)-9

$NaO_2C-\underset{\underset{NaO_2C-CH_2}{|}}{C}H-\overset{\overset{CH_3}{|}}{N}-CH_2\overset{\overset{OH}{|}}{C}HCH_2-\overset{\overset{CH_3}{|}}{N}-\underset{\underset{CH_2CO_2Na}{|}}{C}HCO_2Na$ (Ib)-10

$(NaO_3SCH_2)_2\overset{\overset{OH}{|}}{C}HCH_2N(CH_2SO_3Na)_2$ (Ib)-11

-continued

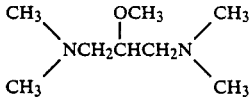
(Ib)-12

$(CH_3OCH_2CH_2)_2N\overset{\overset{OH}{|}}{C}HCH_2N(CH_2CH_2OCH_3)_2$ (Ib)-13

$(CH_3OCH_2CH_2)_2N(CH_2)_4-\overset{\overset{CH_2OH}{|}}{C}H(CH_2CH_2OCH_3)_4$ (Ib)-14

$(CH_3OCH_2CH_2)_2N\overset{\overset{OCH_3}{|}}{C}HCH_2N(CH_2CH_2OCH_3)_2$ (Ib)-15

$(HOCH_2CH_2)_2N\overset{\overset{NH_2}{|}}{C}HCH_2N(CH_2CH_2OH)_2$ (Ib)-16

$(HOCH_2CH_2)_2-N\overset{\overset{NH\overset{\overset{O}{\|}}{C}NH_2}{|}}{C}HCH_2N(CH_2CH_2OH)_2$ (Ib)-17

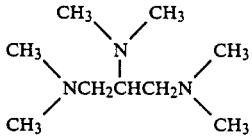
(Ib)-18

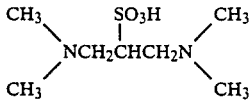
(Ib)-19

$(HO_2CCH_2)_2N\overset{\overset{SO_3H}{|}}{C}HCH_2N(CH_2CO_2H)_2$ (Ib)-20

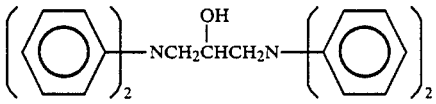
(Ib)-21

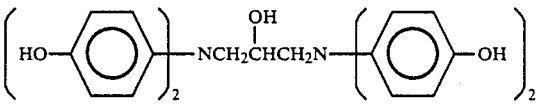
(Ib)-22

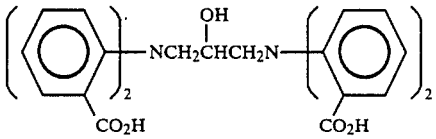
(Ib)-23

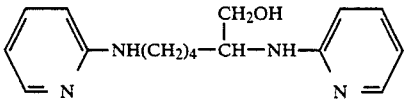
(Ib)-24

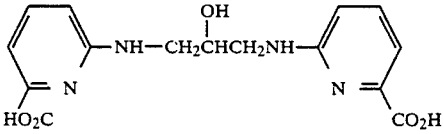
(Ib)-25

-continued

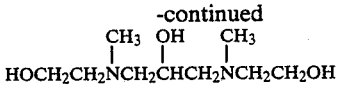
(Ib)-26

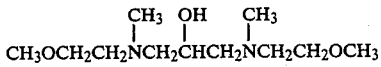
(Ib)-27

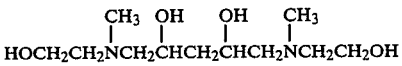
(Ib)-28

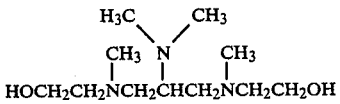
(Ib)-29

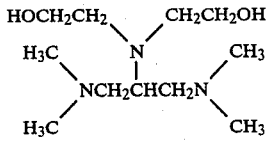
(Ib)-30

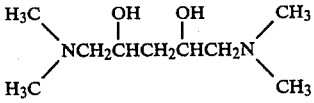
(Ib)-31

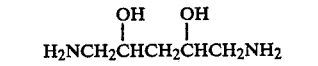
(Ib)-32

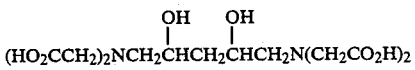
(Ib)-33

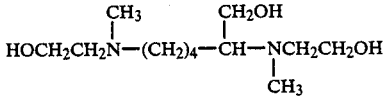
(Ib)-34

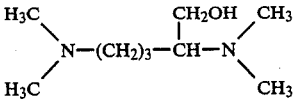
(Ib)-35

Although the compounds represented by general formulae (Ia) and (Ib) are commercially available, the amine compounds represented by general formula (Ia) can be synthesized by generally known reactions, for example, by a reaction of a primary amine or a secondary amine with an alkyl halide or an alkyl sulfonate, as described in *J. Am. Chem. Soc.*, 68, 895 (1946); S. Caspe, *J. Am. Chem. Soc.*, 54, 4457 (1932); E. R. Alexander, *J. Am. Chem. Soc.*, 70, 2592 (1948); P. Kovacic in *Friedel and Related Reactions*, Vol. 3, Part 2, Chapt. 44, edited by G. A. Olah (John Wiley, 1964); F. Minisci, *Synthesis*, 1974, 1. Also, the compounds represented by general formula (Ib) can be synthesized easily according to methods described in *Organic Synthesis I*, 102, 154, 328, 558; III, 370, 800.

The total amount of the compounds represented by general formula (Ia) or (Ib) to be added to a color developing solution is preferably about 0.05 to 30 g per liter, more preferably about 0.1 to 15 g, and most preferably 0.5 to 10 g, per liter.

The color developing solution used in the present invention is now described in greater detail.

The color developing solution used in the present invention contains a known aromatic primary amine color developing agent. Preferred examples of aromatic primary amine color developing agents are p-phenylenediamine derivatives. Typical examples are given below, but the present invention is not limited to these specific examples:

D- 1: N,N-Diethyl-p-phenylenediamine
D- 2: 2-Amino-5-diethylaminotoluene
D- 3: 2-Amino-5-(N-ethyl-N-laurylamino)toluene
D- 4: 4-[N-Ethyl-N-(β- hydroxyethyl)amino]aniline
D- 5: 2-Methyl-4-[N-ethyl-N-(β-hydroxyethyl-)amino]aniline
D- 6: N-Ethyl-N-(β-methanesulfonamidoethyl)-3-methyl-4-aminoaniline
D- 7: N-(2-Amino-5-diethylaminophenylethyl)methanesulfonamide
D- 8: N,N-Dimethyl-p-phenylenediamine
D- 9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline These p-phenylenediamine derivatives may be in the form of salts such as sulfates, hydrochlorides, sulfites and p-toluenesulfonates. The amount of the aromatic primary amine developing agent used is preferably about 0.1 g to about 20 g, more preferably about 0.5 g to about 10 g, per liter of a developing solution.

Particularly, the use of a color developing agent of D-5, D-6 and D-9 in combination with a compound of general formula (Ia) or (Ib) is preferred to limit the increase in fogging and provide good photographic characteristics.

In the color developing solution, it is preferred that p-aminophenol developing agent is not substantially contained. Practically, p-aminophenol developing agent is preferably contained in an amount of less than 1 g, more preferably less than 0.1 g, per liter of the color developing solution in view of stability of the developing solution. Further, it is preferred that the color developing solution substantially contains no couplers, such as color couplers.

In a system wherein an aromatic primary amine color developing agent is used, the compounds of the present invention are remarkably effective preservatives when the compounds are used in combination with a compound capable of directly stabilizing the developing agent. Compounds capable of directly stabilizing a developing agent include generally known water-soluble antioxidants, such as hydroxylamines.

Preferred compounds that can be optionally added to the color developing solution used in the present invention are hydroxylamines, and particularly preferred compounds are represented by the following general formula (II):

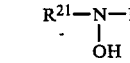
(II)

wherein $R^{21}$ and $R^{22}$, which may be the same or different, each represents a hydrogen atom, a substituted or unsubstituted alkyl group, a substituted or unsubstituted alkenyl group or a substituted or unsubstituted aryl group.

Preferably, $R^{21}$ and $R^{22}$ each represents an alkyl group or an alkenyl group, and it is more preferable that at least one of them have a substituent. $R^{21}$ and $R^{22}$ may be linked to form a heterocyclic ring including the nitrogen atom of general formula (II).

The alkyl group and the alkenyl group represented by $R^{21}$ and $R^{22}$ may be linear, branched or cyclic, and the substituents for these groups include a halogen atom (e.g., F, Cl and Br), an aryl group (e.g., a phenyl group and a p-chlorophenyl group), an alkoxy group (e.g., a methoxy group, an ethoxy group and a methoxyethoxy group), an aryloxy group (e.g., a phenoxy group), a sulfonyl group (e.g., a methanesulfonyl group and a p-toluenesulfonyl group), a sulfonamido group (e.g., a methanesulfonamido group and a benzenesulfonamido group), a sulfamoyl group (e.g., a diethylsulfamoyl group and an unsubstituted sulfamoyl group), a carbamoyl group (e.g., an unsubstituted carbamoyl group and a diethylcarbamoyl group), an amido group (e.g., an acetamido group and a benzamido group), a ureido group (e.g., a methylureido group and a phenylureido group), an alkoxycarbonylamino group (e.g., a methoxycarbonylamino group), an aryloxycarbonylamino group (e.g., a phenoxycarbonylamino group), an alkoxycarbonyl group (e.g., a methoxycarbonyl group), an aryloxycarbonyl group (e.g., a phenoxycarbonyl group), a cyano group, a hydroxyl group, a carboxyl group, a sulfo group, a nitro group, an amino group (e.g., an unsubstituted amino group and a diethylamino group), an alkylthio group (e.g., a methylthio group), an arylthio group (e.g., a phenylthio group) and a heterocyclic ring group (e.g., a morpholino group and a pyridyl group).

The substituent for the aryl group includes the same groups as those for the above-described alkyl group and the alkenyl group.

$R^{21}$ and $R^{22}$ may be the same or different, and the substituents for $R^{21}$ and $R^{22}$ may be the same or different.

Preferably, the carbon number of each of $R^{21}$ and $R^{22}$ is from 1 to 10, more preferably from 1 to 5. Nitrogen-containing heterocyclic rings that may be formed by $R^{21}$ and $R^{22}$ include a piperidyl group, a pyrrolidyl group, an N-alkylpiperadyl group, a morpholyl group, an indolinyl group and a benzotriazole group.

Preferred substituents for $R^{21}$ and $R^{22}$ are a hydroxyl group, an alkoxy group, a sulfonyl group, an amido group, a carboxyl group, a cyano group, a sulfo group, a nitro group and an amino group.

Specific examples of compounds represented by general formula (II) used in the present invention are given below, but the present invention is not to be construed as being limited thereto.

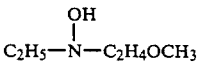
II-(1)

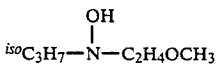
II-(2)

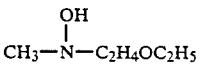
II-(3)

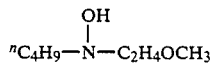
II-(4)

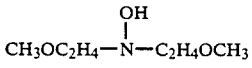
II-(5)

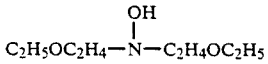
II-(6)

-continued

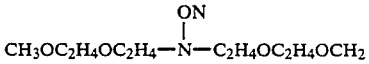
II-(7)

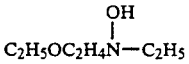
II-(8)

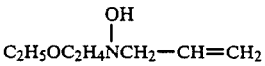
II-(9)

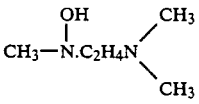
II-(10)

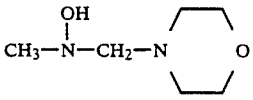
II-(11)

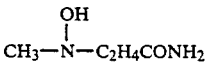
II-(12)

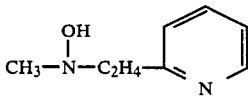
II-(13)

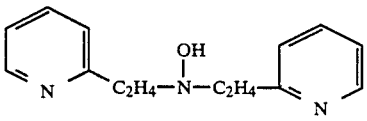
II-(14)

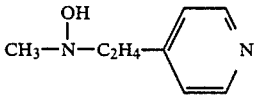
II-(15)

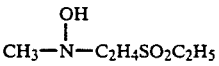
II-(16)

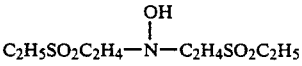
II-(17)

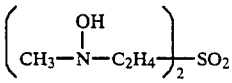
II-(18)

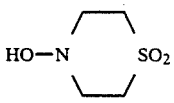
II-(19)

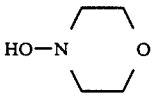
II-(20)

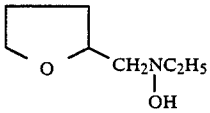
II-(21)

-continued

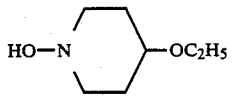

II-(22)

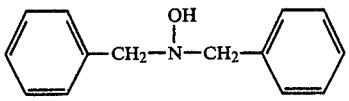

II-(23)

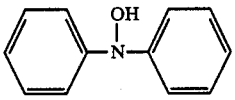

II-(24)

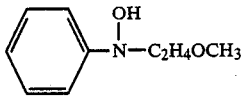

II-(25)

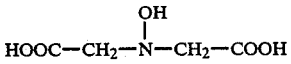

II-(26)

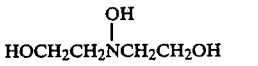

II-(27)

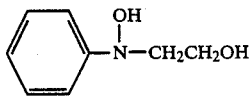

II-(28)

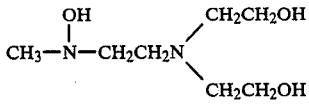

II-(29)

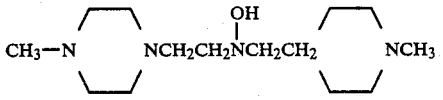

II-(30)

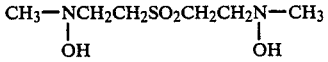

II-(31)

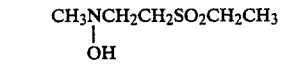

II-(32)

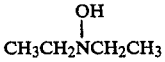

II-(33)

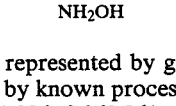

II-(34)

Compounds represented by general formula (II) can be synthesized by known processes as described in U.S. Pat. Nos. 3,661,996, 3,362,961 and 3,293,034, Japanese Patent Publication No. 2794/67 and U.S. Pat. Nos. 3,491,151, 3,655,764, 3,467,711, 3,455,916, 3,287,125 and 3,287,124.

These compounds may form salts with acids such as hydrochloric acid, sulfuric acid, nitric acid, phosphoric acid, oxalic acid and acetic acid. In addition to hydroxylamines, other "compounds capable of directly stabilizing a developing agent", preferred compounds that can be used in combination with the present compounds include, for example, hydrazines and hydrazides as described in Japanese patent application Nos. 170756/86, 171682/86, 173468/86, etc., hydroxamic acids as described in Japanese patent application No. 186559/86, β- hydroxyketones and β-aminoketones as described in Japanese patent application No. 188741/86, phenols as described in Japanese patent application Nos. 188742/86 and 203253/86, and saccharoses as described in Japanese patent application No. 180616/86. In addition to the above compounds, monoamines as described in Japanese patent application Nos. 147823/86, 166674/86, 165621/86, 164515/86, 170789/86, 168159/86, etc., diamines as described in Japanese patent application Nos. 173595/86, 164515/86, 186560/86, etc., polyamines as described in Japanese patent application Nos. 165621/86, 169789/86, etc., polyamines as described in Japanese Patent Application No. 188619/86, nitroxy radicals as described in Japanese patent application No. 197760/86, alcohols as described in Japanese patent application Nos. 186561/86 and 197419/86, oximes as described in Japanese Patent Application No. 198987/86, tertiary amines as described in Japanese patent application No. 265149/86 and condensed cyclic amines as described in Japanese Patent Application No. 24374/87 (such as 1,4-diazabicyclo[2,2,2]octane, etc.) are preferably used together with the compounds of the present invention.

The amount of these compounds to be added to a color developing solution is preferably about 0.01 g to 30 g, more preferably about 0.1 g to 20 g, and most preferably about 0.5 to 10 g, per liter of the color developing solution.

Other preservatives may be added, if desired, for example, sulfites such as sodium sulfite, potassium sulfite, sodium bisulfite, potassium bisulfate, sodium metasulfite and potassium metasulfite, or carbonyl sulfite adducts. The amount of these to be added to a color developing solution is 0 g to about 20 g/liter, preferably 0 g to about 5 g/liter, and it is preferable to use the smallest amount necessary to provide stability to a color developing solution.

Examples of such other preservatives are hydroxyacetones described in U.S. Pat. No. 3,615,503 and British Patent No. 1,306,176; β-aminocarbonyl compounds described in Japanese patent application (OPI) Nos. 143020/77 and 89425/78; metals described in Japanese Patent Application (OPI) Nos. 44148/82 and 53749/82; sugars described in Japanese patent application (OPI) No. 102727/77; β,β'-dicarbonyl compounds described in Japanese patent application (OPI) No. 160141/84; salicylic acids described in Japanese patent application (OPI) No. 180588/84; and gluconic acid derivatives described in Japanese patent application (OPI) No. 75647/81; and two or more of these can be used in combination, if desired. Of these compounds, aromatic polyhydroxy compounds are preferred.

Preferably, the pH of the color developing solution used in the present invention is about 9 to 12, more preferably about 9 to 11.0, and other known compounds that are components of developing solutions can be added to the color developing solution.

To maintain the pH, preferably, various buffers are used. Buffers include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. In particular, carbonates, phosphates, tetraborates, and hydroxybenzoates are excellent in solubility and buffering performance in a high pH range of 9.0 or above. When they are added to the color developing solution, advantageously they do not adversely affect photographic performance (e.g., cause fogging), and they are inexpensive, so that it is particularly preferred to use these buffers.

Examples of these buffers are sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not limited to these compounds.

Preferably, the amount of the buffer added to the color developing solution is at least about 0.1 mol/liter, more preferably about 0.1 mol/liter to 0.4 mol/liter.

Various chelating agents can be used in the color developing solution to prevent precipitation of calcium and magnesium or to improve the stability of the color developing solution.

Preferred chelating agents include organic compounds such as aminopolycarboxylic acids described in Japanese Patent Publication Nos. 30496/73 and 30232/69, organic phosphonic acids described in Japanese Patent Application (OPI) No. 97347/81, Japanese Patent Publication No. 39359/81 and West German Patent No. 2,227,639, phosphonocarboxylic acids described, for example, in Japanese patent application (OPI) Nos. 102726/77, 42730/78, 121127/79, 126241/80 and 659506/80 and compounds described, for example, in Japanese Patent Application (OPI) Nos. 195845/83 and 203440/83 and Japanese patent application No. 40900/78. Specific examples are given below, but the present invention is not limited to them.

Nitrilotriacetic acid,
Diethylenetriaminepentaacetic acid,
Ethylenediaminetetraacetic acid,
Triethylenetetraminehexaacetic acid,
N,N,N-Trimethylenephosphonic acid,
Ethylenediamine-N,N,N',N'-tetramethylenephosphonic acid,
1,3-Diamino-2-propanoltetraacetic acid,
Transcyclohexanediaminetetraacetic acid,
Nitrilotripropionic acid,
1,2-Diaminopropanetetraacetic acid,
Hydroxyethyliminodiacetic acid,
Glycol ether diaminetetraacetic acid,
Hydroxyethylenediaminetriacetic acid,
Ethylenediamineorthohydroxyphenylacetic acid,
2-Phosphonobutane-1,2,4-tricarboxylic acid,
1-Hydroxyethylidene-1,1-diphosphonic acid, and
N,N'-Bis(2-hydroxybenzyl)ethylenediamine-N,N'-diacetic acid.

Two or more of these chelating agents may be used in combination, if desired.

The amount of these chelating agents added is any amount enough to capture the metal ions in the color developing solution, for example, on the order of about 0.1 to 10 g per liter.

If desired, a development accelerator may be added to the color developing solution, without particular limitation. However, in view of prevention of environmental hazards, ease of preparation of the solution, and prevention of fogging, the present color developing solution is substantially free from benzyl alcohol. Herein, the term "substantially free from benzyl alcohol" means that the amount of benzyl alcohol per liter of color developing solution is up to about 2 ml, and preferably no benzyl alcohol is added.

The compounds represented by general formulae (Ia) and (Ib) used in the present invention have a remarkable effect in stabilizing a color developing solution substantially free from benzyl alcohol.

Other development accelerators that can be used include thioether compounds disclosed, for example, in Japanese Patent Publication Nos. 16088/62, 5987/62, 7826/63, 12380/69 and 9019/70 and U.S. Pat. No. 3,813,247; p-phenylenediamine compounds disclosed in Japanese Patent Application (OPI) Nos. 49829/77 and 15554/75; quaternary ammonium salts disclosed, for example, in Japanese patent application (OPI) No. 137726/75, Japanese Patent Publication No. 30074/69 and Japanese Patent Application (OPI) Nos. 156826/81 and 43429/77; p-aminophenols described in U.S. Pat. Nos. 2,610,122 and 4,119,462; amine compounds described, for example, in U.S. Pat. Nos. 2,494,903, 3,128,182, 4,230,796 and 3,253,919, Japanese Patent Publication No. 11431/66 and U.S. Pat. Nos. 2,482,546, 2,596,926 and 3,582,346; polyalkylene oxides disclosed, for example, in Japanese Patent Publication Nos. 16088/62 and 25201/67, U.S. Pat. No. 3,128,183, Japanese Patent Publication Nos. 11431/66 and 23883/67 and U.S. Pat. No. 3,532,501; as well as 1-phenyl-3-pyrazolidones; hydrazines; mesoionic compounds; ionic compounds; and imidazoles, which can be optionally used.

In the present invention, an antifoggant can be optionally used without limitation, including alkali metal halides such as sodium chloride, potassium bromide and potassium iodide and organic antifoggants. Typical examples of organic antifoggants include nitrogen-containing heterocyclic ring compounds such as benzotriazole, 6-nitrobenzimidazole, 5-nitroisoindazole, 5-methylbenzotrizole, 5-nitrobenzotriazole, 5-chlorobenzotriazole, 2-thiazolylbenzimidazole, 2-thiazolylmethylbenzimidazole, indazoles, hydroxyazaindolizine and adenine.

Preferably, the present color developing solution contains a fluorescent brightening agent. Preferred brightening agents include 4,4'-diamino-2,2'-disulfostilbene compounds. The amount of brightening agent added is about 0 to 5 g/liter, preferably about 0.1 to 4 g/liter.

If desired, surface active agents such as alkyl sulfonic acids, aryl phosphonic acids, aliphatic carboxylic acids and aromatic carboxylic acids may be added to the developer solution.

The additives described above are preferably used in an amount of about 0.001 to 10 g, more preferably 0.005 g to 5 g, per liter.

The processing temperature of the present color developing solution is about 20° to 50° C., preferably about 30° to 40° C. The processing time is about 20 seconds to 5 minutes, preferably about 30 seconds to 2 minutes. It is preferred that the replenishing amount be small and the replenishing amount is generally about 20 to 600 ml, preferably about 50 to 300 ml, and more preferably about 100 to 200 ml, per $m^2$ of the photosensitive material processed according to the invention.

The bleaching solution, the bleach-fix solution and the fixer used in the present invention are now described.

Although any conventional bleaching agent can be used in the bleaching solution or the bleach-fix solution used in the present invention, it is preferred to use organic complex salts of iron (III) (e.g., complex salts of aminopolycarboxylic acids (such as ethylenediaminetetraacetic acid and diethylenetriaminepentaacetic acid) and organic phosphonic acids (such as aminopolyphosphonic acids and phosphonocarboxylic acids)), organic acids such as citric acid, tartaric acid and malic acid; persulfates; and hydrogen peroxide. In these compounds, organic complex salts of iron (III) and persulfates are preferred from the viewpoint of quick processing and the prevention of environmental pollution. Examples of aminopolycarboxylic acid and aminopolyphosphonic acid or organic phosphonic acid useful for forming the organic complex salts of iron (III), are:

Ethylenediaminetetraacetic acid,
Diethylenetriaminepentaacetic acid,
Ethylenediamine-N-(β-oxyethyl)-N,N', N'-triacetic acid
1,3-Diaminopropanetetraacetic acid,
Triethylenetetraminehexaacetic acid,
Propylenediaminetetraacetic acid,
Nitrilotriacetic acid,
Nitrilotripropionic acid,
Cyclohexanediaminetetraacetic acid,
1,3-Diamino-2-propanoltetraacetic acid,
Methyliminodiacetic acid,
Iminodiacetic acid,
Hydroxyliminodiacetic acid,
Dihydroxyethylglycine ethyl ether diaminetetraacetic acid,
Glycol ether diaminetetraacetic acid,
Ethylenediaminetetrapropionic acid,
Ethylenediaminedipropionic acid,
Phenylenediaminetetraacetic acid,
2-Phosphonobutane-1,2,4-triacetic acid,
1,3-Diaminopropanol-N,N,N',N'-tetramethylenephosphonic acid,
Ethylenediamine-N,N,N',N'-tetramethylenephosphonic acid,
1,3-Propylenediamine-N,N,N',N'-tetramethylenephosphonic acid,
1-Hydroxyethylidene-1,1'-diphosphonic acid, etc.

These compounds may form any salt of sodium, potassium, lithium and ammonium.

In these compounds, the iron (III) complex salts of ethylenediaminetetraccetic acid, diethylenetriaminepentaacetic acid, cyclohexanediaminetetraacetic acid, 1,3-diaminopropanetetraacetic acid, and methyliminodiacetic acid are preferred from the viewpoint of high beaching power.

These ferric ion complex salts may be used in the form of a complex salt or a ferric ion complex salt may be formed in solution using (a) a ferric salt such as ferric sulfate, ferric chloride, ferric nitrate, ammonium iron (III) sulfate and ferric phosphate and (b) a chelating agent such as an aminopolycarboxylic acid, an aminopolyphosphonic acid and a phosphonocarboxylic acid. One or more complex salts may be used in the form of complex salts, or alternatively one or more ferric salts can be used to form complex salts in solution by using ferric salts and a chelating agent. Further, one or more chelating agents may be used. In either case, a chelating agent may be used in excess of the stoichiometric amount required to form a ferric ion complex salt. Of iron complex salts, aminopolycarboxylic acid iron complex salts are preferred, and the amount used is about 0.01 to 1.0 mol/liter, preferably about 0.05 to 0.50 mol/liter.

Further, if desired, the bleaching solution or the bleach-fix solution may contain a bleach accelerating agent. Specific examples of useful bleach accelerating agents include compounds having a mercapto group or a disulfide group described, for example, in U.S. Pat. No. 3,893,858, West German Patent Nos. 1,290,812 and 2,059,988, Japanese patent application (OPI) Nos. 32736/78, 57831/78, 37418/78, 65732/78, 72623/78, 95630/78, 95631/78, 104232/78, 124424/78, 141623/78 and 28426/78 and *Research Disclosure*, No. 171129 (July, 1978); thiazolidine derivatives as described in Japanese Patent Application (OPI) No. 140129/75; thiourea derivatives described in Japanese Patent Publication No. 8506/70, Japanese patent application (OPI) Nos. 20832/77 and 32735/78 and U.S. Pat. No. 3,706,561; iodides described in West German Patent No. 1,127,715 and Japanese patent application (OPI) No. 16235/83; polyethylene oxides described in West German Patent Nos. 966,410 and 2,748,430; polyamine compounds described in Japanese Patent Publication No. 8836/70; and iodide and bromide ions and compounds described in Japanese patent application (OPI) Nos. 42434/74, 59644/74, 94927/78, 35727/79, 26506/80 and 163940/83. Of these, compounds having a mercapto group or a disulfide group are preferred in view of their high acceleration effect, and, in particular, compounds described in U.S. Pat. No. 3,893,858, West German Patent 1,290,812 and Japanese patent application (OPI) No. 95630/78 are preferred.

It is preferred that the bleach liquid or blix liquid for use in this invention contains a rehalogenating agent such as a bromide (e.g., potassium bromide, sodium bromide, ammonium bromide, etc.), a chloride (e.g., potassium chloride, sodium chloride, ammonium chloride, etc.), and an iodide (e.g., ammonium iodide, etc.). Also, if necessary, the bleach liquid or blix liquid may further contain a corrosion inhibitor such as an inorganic acid or an organic acid having a pH buffering capability, or the alkali metal salt or ammonium salt thereof, such as boric acid, borax, sodium metaborate, acetic acid, sodium acetate, sodium carbonate, potassium carbonate, phosphorus acid, phosphoric acid, sodium phosphate, citric acid, sodium citrate, tartaric acid, etc., or ammonium nitrate, guanidine, etc.

As the fixing agent which is used for the fix or the blix in this invention, there are thiosulfates such as sodium thiosulfate, ammonium thiosulfate, etc.; thiocyanates such as sodium thiocyanate, ammonium thiocyanate, etc.; thioether compounds such as ethylenebisthioglycolic acid, 3,6-dithia-1,8-octanediol, etc.; and water-soluble silver halide dissolving agents such as thioureas, etc. They may be used solely or as a mixture thereof. Furthermore, for the blix processing in this invention, a specific blix liquid composed of a combination of a fixing agent and a large amount of a halide such as potassium iodide, etc., as described in Japanese Patent Application (OPI) No. 155354/80 can be also used.

In the present invention, it is preferred to use a thiosulfate, particularly ammonium thiosulfate, in the fixing bath or bleach-fixing bath as a fixing agent.

Preferably the amount of fixing agent used per liter is in the range of about 0.3 to 2 mol, more preferably about 0.5 to 1.0 mol.

Preferably, the pH range of the bleach-fix solution or fixer in the present invention is about 3 to 10, more preferably about 5 to 9. When the pH is lower, although the desilvering ability may be improved, deterioration of the solution and production of leuco compound from cyanine dyes are increased. By contrast, when the pH is higher, desilvering is slowed, and staining is liable to occur.

To adjust the pH, for example, hydrochloric acid, sulfuric acid, nitric acid, acetic acid, a bicarbonate, ammonia, caustic potash, caustic soda, sodium carbonate or potassium carbonate is added as required.

Further, the bleach-fix solution can contain a fluorescent brightening agent, an antifoaming agent, a surface active agent, a polyvinyl pyrrolidone and an organic solvent such as methanol.

The bleach-fix solution or the fixing solution in the present invention contains, as a preservative, a sulfite ion-releasing compound such as a sulfite (e.g., sodium sulfite, potassium sulfite and ammonium sulfite), a bisulfite (e.g., ammonium bisulfite, sodium bisulfite and potassium bisulfite) and a metabisulfite (e.g., potassium metabisulfite, sodium metabisulfite and ammonium metabisulfite). Preferably, these compounds are present in an amount of about 0.02 to 0.50 mol/liter, more preferably about 0.04 to 0.40 mol/liter in terms of sulfite ion.

Although, generally, as a preservative a sulfite is added, for example, ascorbic acid, a carbonyl bisulfite adduct or a carbonyl compound also can be used.

Further, for example, a buffering agent, a fluorescent brightening agent, a chelating agent and an antimildew agent can be added, if required.

The washing step of the present invention is now described in detail. The term "washing step" as used herein includes processes which can be substituted for a conventional water washing step, such as a rinsing process and a water washing promoting process.

In the present invention, instead of the usual "washing process", a "stabilizing process", for example, without a substantial washing step can be used alone. Thus, in the present invention, the term "washing process" is broad enough to include any of the above processes.

Since the amount of washing water or of stabilizing solution used in the present invention varies depending on the number of baths of a multicountercurrent washing process, and the quantity of components of the photosensitive material carried over from the preceding bath, although it is hard to specify the quantity, it is generally sufficient if the bleaching or fixer components in the final bath or the bath after the bath having a fixing function is decreased to about $1\times10^{-4}$ times the concentration of these components in the original bath. For example, in the case of three-tank countercurrent washing, it is preferred that the washing water quantity be at least about 1,000 ml, more preferably at least about 5,000 ml, per $m^2$ of the photosensitive material. When it is desired to save water, the quantity used is about 100 to 1,000 ml per $m^2$ of the photosensitive material.

The washing process or stabilizing process temperature is typically about 15° to 45° C., preferably about 20° to 35° C.

For the purpose of preventing precipitation or stabilizing the washing water, various known compounds may be added to the washing step bath. For example, an inorganic phosphoric acid, a chelating agent such as aminocarboxylic acids and organic phosphonic acids, a fungicide or an antifungal agent for preventing bacteria, algae or mold from occurring, as described, for example, in *Journal of Antibact. Antifung. Agents*, Vol. 11, No. 5, pages 207 to 223 (1983), and by Hiroshi Horiguchi in *Bokin Bobai no Kagaku*, a metal salt such as a magnesium salt and an aluminum salt, an alkali metal salt, an ammonium salt, and a surface active agent for preventing uneven washing or drying load may be added, if desired. Further, compounds described, for example, by West in *Photographic Science and Engineering*, Vol. 6, pages 344 to 359 (1965) may be added.

The present invention is particularly useful when a chelating agent, a fungicide and an antifungal agent are added to washing water, and water is greatly saved by multi-countercurrent washing using two or more tanks. The present invention is also particularly useful when instead of the usual washing stage, a multicountercurrent stabilizing process ("stabilizing process") as described in Japanese Patent Application (OPI) No. 8543/82 is used. In these cases, it is sufficient if the bleaching or fixing components in the final bath are decreased to about $5\times10^{-2}$ or below, preferably about $1\times10^{-2}$, times the original concentration of these components. It is also effective to use only water from which calcium ions and magnesium ions are substantially removed, such as distilled water and deionized water, to greatly reduce the amount of water used.

For the purpose of stabilizing the image, various compounds can be optionally added to the stabilizing bath. For example, various buffering agents (e.g., borates, metaborates, borax, phosphates, carbonates, potassium hydroxide, sodium hydroxide, ammonia water, monocarboxylic acids, dicarboxylic acids and polycarboxylic acids that are used in combination) for adjusting the film pH (e.g., to a pH of about 3 to 8) and aldehydes such as formaldehyde can be used. Further, chelating agents (e.g., inorganic phosphoric acids, aminopolycarboxylic acids, organic phosphonic acids, aminopolyphosphonic acids and phosphonocarboxylic acids), fungicides (e.g., thiazole tungicides, isothiazole fungicides, halogenated phenols, sulfanilamide and benzotriazole), surface active agents, fluorescent brightening agents, and hardening agents can be used, and two or more of them can be used in combination.

To improve the stability of the color image formed, it is preferred to add, as a film pH adjusting agent to the stabilization bath, an ammonium salt such as ammonium chloride, ammonium nitrate, ammonium sulfate, ammonium phosphate, ammonium sulfite and ammonium thiosulfate. It is also preferred that a process to decrease an amount of Ca or Mg as described in Japanese Patent Application No. 131632/86 is employed to improve the stability of washing water.

When the amount of washing water or a stabilizing solution is required to be reduced, it is preferred to introduce part or all of the overflow of washing water into the preceding bleach-fix bath or fixing bath, to decrease the amount of discharge.

In continuous processing, the use of replenishing solutions can prevent the solution compositions from fluctuating, thereby securing consistent results. The replenishing amount can be decreased to half of the standard replenishing amount, or can be further decreased, to reduce costs.

Each processing bath may be provided, as desired, with any conventional processing apparatus without limitation, including a heater, a temperature sensor, a level sensor, a circulating pump, a filter, a floating lid, a squeegee, a nitrogen agitation equipment, an air agitation equipment, etc.

The present method can be applied to any processing method in which a color developing solution is used. For example, the present method can be applied to development of color paper, color reversal paper, color positive film, color direct positive film, color negative film and color reversal film, and is particularly advantageous when applied to the development of color paper and color reversal paper.

Although the silver halide emulsion of the photographic material used in the present invention may have any halogen composition, including silver bromoiodide, silver bromide, silver chlorobromide, silver chloride, etc., when rapid processing or a low replenishment processing is carried out, it is preferred to use a silver chloride emulsion or a silver chlorobromide emulsion containing at least about 60 mol %, more preferably about 80 to 100 mol %, of silver chloride. When high sensitivity is required, and fogging during the production, storage and/or processing is required to be particularly reduced, it is preferred to use a silver bromide emulsion or a silver chlorobromide emulsion containing at least about 50 mol %, more preferably at least about 70 mol %, of silver bromide. If the content of silver bromide is about 90 mol % or over, rapid processing becomes difficult. It is at times preferred to use a technique for accelerating development, for example, using a development accelerator such as a developer, a fogging agent or a silver halide solvent described later, since such a technique makes development accelerate to some degree without being restricted by the content of silver halide. In any case, it is preferred that the emulsion not contain a large amount of silver iodide, and it is sufficient that the amount of silver bromide be at most about 3 mol %, in silver halide emulsions used for color paper. In the case of color photographic films (e.g., negative films and reversal films), silver bromoidide and silver bromochloroiodide emulsions are preferred in which the content of silver bromide is preferably about 3 to 15 mol %.

In the silver halide grains contained in these emulsions, the phase of the core may differ from the phase of the surface layer; a multiple phase structure having a junction structure may be used; or the entire grain may be composed of a uniform phase. These grains may be present as a mixture.

Average grain size of silver halide grains (the grain size being defined as grain diameter if the grain has a spherical or a nearly spherical form and as a length of the edge if the grain has a cubic form, and being averaged based on projected areas of the grains, plate like grain is calculated as a spherical form) is preferably from 0.1 μm to 2 μm, and particularly from 0.15 μm to 1.5 μm. Grain size distribution may be either narrow or broad.

A so-called monodispersed silver halide emulsion can be employed in the present invention. The degree of monodispersity is indicated using a value, i.e., a coefficient of variation, which is obtained by dividing a standard deviation derived from grain size distribution curve of silver halide by an average grain size, and the coefficient of variation is preferably 20% or less and particularly 15% or less. Further, in order to achieve the desired gradation of the light-sensitive material, two or more monodispersed silver halide emulsions (preferably having the above described coefficient of variation) which have different grain sizes from each other can be mixed in one emulsion layer or can be coated in the form of superimposed layers which have substantially the same spectral sensitivity. Moreover, two to more polydispersed silver halide emulsions or combinations of a monodispersed emulsion and a polydispersed emulsion may be employed in a mixture or in the form of superimposed layers.

Silver halide grains which can be used in the present invention may have a regular crystal structure, for example, a cubic, octahedral, dodecahedral or tetradechedral structure, etc., an irregular crystal structure, for example, a spherical structure, etc., or a composite structure thereof. Further, tabular silver halide grains can be used. Particularly, a silver halide emulsion wherein tabular silver halide grains having a ratio of diameter/thickness of not less than 5, preferably not less than 8, account for at least 50% of the total projected area of the silver halide grains present can be employed. In addition, mixtures of silver halide grains having different crystal structures may be used. These silver halide emulsions may be those of surface latent image type in which latent images are formed mainly on the surface thereof, those of internal latent image type in which latent images are formed mainly in the interior thereof.

Photographic emulsions as used in the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsion,* The Focal Press (1964), and *Research Disclosure,* Vol. 170, Item No. 176, 43 (I) (December, 1978). That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (so-called reversal mixing process) in which silver halide grains are formed in the presence of an excess of silver ions. A conversion method wherein a halogen salt which can form more insoluble silver halide is added may also be used. As one system of the double jet process, a so-called controlled double jet process in which the pAg in a liquid phase where silver halide is formed is maintained at a predetermined level can be employed. This process can prepare a silver halide emulsion in which the crystal form is regular and the particle size is nearly uniform.

Further, an emulsion prepared by a conversion process can be used, by which a silver halide already formed is converted to a silver halide whose solubility product is smaller, before completing the formation of the silver halide grains. Alternatively, an emulsion which is subjected to similar halogen conversion after completing the formation of the silver halide grains can also be used.

During the step of formation or physical ripening of silver halide grains, cadmium salts, zinc salts, lead salts, thallium salts, iridium salts or complex salts thereof, rhodium salts or complex salts thereof, iron salts or complex salts thereof, etc., may be allowed to coexist.

After the formation of silver halide grains, silver halide emulsions are usually subjected to physical ripening, removal of soluble salts and chemical ripening and then employed for coating.

Known silver halide solvents (for example, ammonia, potassium thiocyanate, and thioethers and thione compounds as described in U.S. Patent No. 3,271,157, Japanese patent application (OPI) Nos. 12360/76, 82408/78, 144319/78, 100717/79, 155828/79, etc.) can be employed during the step of formation, physical ripening or chemical ripening of silver halide.

For removal of soluble silver salts from the emulsion after physical ripening, a noodle washing process, a flocculation process, an ultrafiltration process, etc., can be employed.

The silver halide emulsions in materials processes by the present invention can be sensitized, e.g., by any of a sulfur sensitization method that uses activated gelating and a compound (e.g., thiosulfates, thioureas, mercapto compounds and rhodanine) containing sulfur capable of reacting with silver; a reduction sensitization method that uses a reducing material (e.g., stannous salts, amines, hydrazine derivatives, formamidinesulfinic acid and silane compounds); and a noble metal sensitization method that uses a metal compound (e.g., gold complex salts, and complex salts of metals of Group VIII of the Periodic Table such as Pt, Ir, Pd, Rh and Fe), either alone or in combination.

The blue-sensitive, green-sensitive and red-sensitive emulsions used in the present invention are typically spectrally sensitized using methine dyes and other dyes to have the respective color sensitivities.

The dyes used for the purpose include cyanine dyes, merocyanine dyes, complex cyanine dyes, complex merocyanine dyes, holopolar cyanine dyes, hemicyanine dyes, styryl dyes, and hemioxonol dyes. Particularly useful dyes are dyes belonging to cyanine dyes, merocyanine dyes and complex merocyanine dyes.

For these dyes can be applied nuclei which are usually utilized as base heterocyclic nuclei. Examples of these nuclei are pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing an alicyclic hydrocarbon ring to the aforesaid nuclei or the nuclei formed by fusing an aromatic hydrocarbon ring to the aforesaid nuclei, i.e., indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinone nuclei, etc. These nuclei may have a substituent on the carbon atom thereof.

For the merocyanine dyes or complex merocyanine dyes can be applied 5- or 6-membered heterocyclic nuclei such as pyrazoline-5-one nuclei, thiohydantoin nuclei, 1-thiooxazolidine-2,4-dione nuclei, thiazolidine-2,4-dione nuclei, rhodanine nuclei, thiobarbituric acid nuclei, etc., as nuclei having a ketomethylene structure.

The sensitizing dyes described above may be used singly or as a combination thereof, and a combination of sensitizing dyes is frequently used for super color sensitization.

Useful sensitizing dyes are disclosed in *Research Disclosure,* Vol. 176, Item No. 17643 (IV) (December, 1978), U.S. Pat. Nos. 2,688,545 2,0977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78 and Japanese patent application (OPI) Nos. 10618/77 and 109925/77.

In addition to a sensitizing dye, the emulsion can contain a dye that does not itself have a spectral sensitizing effect, or a material that does not substantially absorb visible light, but that exhibits a supersensitizing effect.

These sensitizing dyes may be added at the time of grain formation, before or after chemical sensitization, at the time of chemical sensitization or at the time of coating. When a sensitizing dye is added at the time of grain formation, not only is the adsorption enhanced, but it is also effective for control of the crystalline configuration of grains or the control of the grain structure. When a sensitizing dye is added at the time of chemical sensitization, not only is the adsorption enhanced, but it is also effective to control the sites of chemical sensitization and to prevent crystals from being distorted. These methods of addition are particularly useful when an emulsion contains a high silver halide content, and are also particularly useful when applied to grains in which the grain surface is increased in silver bromide or silver iodide content.

It is preferable that these couplers are incorporated into photographic light-sensitive materials and these couplers are rendered diffusion resistant by means of containing a ballast group or being polymerized. It is also preferred that the coupling active position of these couplers is substituted with a group capable of being released (2-equivalent couplers) than with a hydrogen atom (4-equivalent couplers) from the standpoint that the coating amount of silver is reduced. Further, couplers which form dyes having an appropriate diffusibility, non-color-forming couplers, or couplers capable of releasing development inhibitors (DIR couplers) or development accelerators accompanying with the coupling reaction can also be employed.

Typical examples of oil protect type acylacetamide series couplers are described in U.S. Pat. Nos. 2,407,210, 2,875,057 and 3,265,506. In the present invention, the use of 2-equivalent yellow couplers is preferred, and typical examples thereof are oxygen atom coupling-off yellow couplers described, for example, in U.S. Pat. Nos. 3,408,194, 3,447,928, 3,933,501 and 4,022,620; and nitrogen atom coupling-off yellow couplers described, for example, in Japanese Patent Publication No. 10739/80, U.S. Pat. Nos. 4,401,752, 4,326,024, *Research Disclosure,* No. 18053 (April, 1979), British Pat. No. 1,425,020, and West German Offenlegungsschriften 2,219,917, 2,261,361, 2,329,587 and 2,433,812. α-Pivaloylacetanilide couplers are excellent in fastness, particularly fastness to light, of the developed color dye, while α-benzoylacetanilide couplers can provide a high developed color density.

Magenta couplers used in the p;resent invention include oil protected indazolone type couplers, cyanoacetyl type couplers, and preferably 5-pyrazolone type couplers and pyrazoloazole type couplers such as pyrazolotriazoles. Of 5-pyrazolone type couplers, those substituted with an arylamino group or an acylamino group at the 3-position thereof are preferred in view of hue and a color density of dyes formed. Typical examples thereof are described in U.S. Pat. Nos. 2,311,082, 2,343,703, 2,600,788, 2,908,573, 3,062,653, 3,152,896, 3,936,015, etc. 2-Equivalent 5-pyrazolone type couplers are preferably used. Particularly, nitrogen atom-releasing groups as described in U.S. Pat. No. 4,310,619 and arylthio groups as described in U.S. Pat. No. 4,351,897 are preferred as releasing groups. Further, 5-pyrazolone type couplers having a ballast group as described in European Pat. No. 73,636 are advantageous because they provide a high color density.

Examples of pyrazoloazole type couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure,* RD No. 24220 (June, 1984) and Japanese patent application (OPI) No. 33552/85 and pyrazolopyrazoles as described in *Research Disclosure, RD No.* 24230 (June, 1984) and Japanese patent application (OPI) No. 43659/85. Imidazo[1,2-b]pyrazoles as described in European Pat. No. 119,741 are preferred, and pyrazolo[1,5-b] [1,2,4]triazoles as described in European Pat. No. 119,860 are particularly preferred in view of less yellow subsidiary absorption and light fastness of dyes formed.

As cyan couplers used in the present invention, oil protection naphthol type and phenol type couplers are exemplified. Typical examples thereof include naphthol type couplers as described in U.S. Pat. No. 2,474,293 and preferably oxygen atom-releasing type 2-equivalent naphthol type couplers as described in U.S. Pat. Nos. 4,052,212, 4,146,396, 4,228,233, 4,296,200, etc. Specific examples of phenol type couplers are described in U.S. Pat. Nos. 2,369,929, 2,801,171, 2,772,162, 2,895,826, etc.

Cyan couplers fast to humidity and temperature are preferably used in the present invention. Typical examples thereof include phenol type cyan couplers having an alkyl group having more carbon atoms than a methyl group at the meta-position of the phenol nucleus as described in U.S. Pat. Nos. 3,772,002, 2,5-diacylamino-substituted phenol type couplers as described in U.S. Pat. Nos. 2,772,162, 3,758,308, 4,126,396, 4,334,011 and 4,327,173, West German patent application (OLS) No. 3,329,729, European Pat. No. 121,365, etc., and phenol type couplers having a phenylureido group at the 2-position thereof and an acylamino group at the 5-position thereof as described in U.S. Pat. No. 3,446,622, 4,333,999, 4,451,559, 4,427,767, etc.

Particularly, in the present method of processing, by using color materials containing at least one of cyan couplers represented by the general formulae (C-I) and (C-II) given below, fogging is reduced and good photographic characteristics can be obtained. The improvement obtained when processing these materials is unexpectedly significant and surprising.

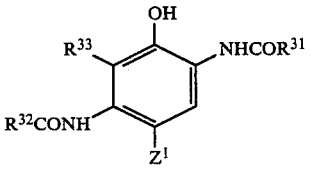

(C-I)

wherein $R^{31}$ represents an alkyl group, a cycloalkyl group, each having 1 to 32 carbon atoms, an arylamino group having 6 to 32 carbon atoms, an amino group or a heterocyclic ring group including a 5- or 6-membered ring containing at least one hetero atom of S, N and O; $R^{32}$ represents an alkyl group having 1 to 32 carbon atoms or an aryl group having 6 to 32 carbon atoms; $R^{33}$ represents a hydrogen atom, a halogen atom, an alkyl group having 1 to 32 carbon atoms or an alkoxy group having 1 to 32 carbon atoms, and $R^{33}$ may be linked with $R^{32}$ to form a ring; and $Z^1$ represents a hydrogen atom, a halogen atom or a coupling-off group capable of being cleaved by a reaction of the coupler with the oxidation product of an aromatic primary amine color developing agent;

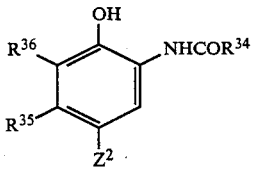

(C-II)

wherein $R^{34}$ represents an alkyl group, a cycloalkyl group each having 1 to 32 carbon atoms, an aryl group having 6 to 32 carbon atoms or a heterocyclic group including a 5- or 6-membered ring containing at least one hetero atom or S, N and O; $R^{35}$ represents an alkyl group having at least 2 carbon atoms; $R^{36}$ represents a hydrogen atom, a halogen atom or an alkyl group having 1 to 32 carbon atoms; and $Z^2$ represents a hydrogen atom, a halogen atom or a coupling-off group capable of being cleaved by a reaction of the coupler with the oxidation product of an aromatic primary amine color developing agent.

In cyan couplers represented by general formulae (C-I) and (C-II), examples of the alkyl group represented by $R^{31}$, $R^{32}$ and $R^{34}$ having 1 to 32 carbon atoms include a methyl group, a butyl group, a tridecyl group, a cyclohexyl group and an allyl group. Examples of the aryl groups represented by $R^{31}$, $R^{32}$ and $R^{34}$ include a phenyl group and a naphthyl group, and examples of the heterocyclic ring group represented by $R^{31}$, $R^{32}$ and $R^{34}$ include a 2-pyridyl group, a 2-imidazolyl group, a 2-furyl group and a 6-quinolyl group. Substituents for $R^{31}$, $R^{32}$ and $R^{34}$ include an alkyl group, an aryl group, a heterocyclic group, an alkoxy group (e.g., a methoxy group, a 2-methoxyethoxy group, etc.), an aryloxy group (e.g., a 2,4-di-t-amylphenoxy group, a 2-chlorophenoxy group, a 4-cyanophenoxy group, etc.), an alkenyloxy group (e.g., a 2-propenyloxy group, etc.), an acyl group (e.g., an acetyl group, a benzoyl group, etc.), an ester group (e.g., a butoxycarbonyl group, a phenoxycarbonyl group, an acetoxy group, a benzoyloxy group, a butorysulfonyl group, a toluenesulfonyloxy group, etc.), an amido group (e.g., an acetylamino group, a methanesulfonamido group, a dipropylsulfamoylamino group, etc.), a carbamoyl group (e.g., a dimethylcarbamoyl group, an ethylcarbamoyl group, etc.), a sulfamoyl group (e.g., a butylsulfamoyl group, etc.), an imido group (e.g., a succinimido group, a hydantoinyl group, etc.), a ureido group (e.g., a phenylureido group, a dimethylureido group, etc.), an aliphatic or aromatic sulfonyl group (e.g., a methanesulfonyl group, a phenylsulfonyl group, etc.), an aliphatic or aromatic thio group (e.g., an ethylthio group, a phenylthio group, etc.), a hydroxyl group, a cyano group, a carboxyl group, a nitro group, a sulfo group, a halogen atom, etc.

When $R^{31}$ represents an amino group, the amino group may have one or more substituents. The substituents for the amino group include the same substituents as described above. Preferred substituted amino group for $R^{31}$ includes an anilino group and a thiazolylamino group.

In general formula (C-I), when $R^{33}$ represents a substituent capable of being substituted, $R^{33}$ may be substituted by a substituent capable of being substituted as described for $R^{31}$.

In general formula (C-II), examples of the alkyl group that is represented by $R^{35}$ and may have at least 2 carbon atoms are an ethyl group, a propyl group, a butyl group, a pentadecyl group, a tert-butyl group, a cyclohexyl group, a cyclohexylmethyl group, a phenylthiomethyl group, a dodecyloxyphenylthiomethyl group, a butanamidomethyl group and a methoxymethyl group.

In general formulae (C-I) and (C-II), $Z^1$ and $Z^2$ each represents a hydrogen atom or a coupling-off group (as used therein, the term "coupling-off group" includes a coupling-off atom) and examples thereof include a halogen atom (e.g., a fluorine atom, a chlorine atom and a bromine atom), an alkoxy group having 1 to 32 carbon atoms (e.g., an ethoxy group, a dodecyloxy group, a methoxyethylcarbamoylmethoxy group, a carboxypropyloxy group and a methylsulfonylethoxy group), an aryloxy group having 6 to 32 carbon atoms (e.g., a 4-chlorophenoxy group, a 4-methoxyphenoxy group and a 4-carboxyphenoxy group), an acyloxy group (e.g., an acetoxy group, a tetradecanoyloxy group and a benzoyloxy group), a sulfonyloxy group (e.g., a methanesulfonyloxy group and a toluenesulfonyloxy group), an amido group (e.g., a dichloroacetylamino group, a heptafluorobutylamino group, a methanesulfonylamino group and a toluenesulfonylamino group), an alkoxycarbonyloxy group having 2 to 32 carbon atoms (e.g., an ethoxycarbonyloxy group and a benzyloxycarbonyloxy group), an aryloxycarbonyloxy group having 7 to 32 carbon atoms (e.g., a phenoxycarbonyloxy group), an aliphatic or aromatic thio group (e.g., an ethylthio group, a phenylthio group and a tetraxolylthio group), an imido group (e.g., a succinimido group and a hydantoinyl group) and an aromatic azo group (e.g., a phenylazo group). These coupling-off groups may contain a photographically useful group.

Preferred examples of cyan couplers represented by general formulae (C-I) and (C-II) are given below.

Preferably, in general formula (C-I), $R^{31}$ represents an aryl group or a heterocyclic ring group; and more preferably an aryl group substituted by a halogen atom, an alkyl group, an anloxy group, an aryloxy group, an acylamino group, an acyl group, a carbamoyl group, a sulfonamido group, a sulfamoyl group, a sulfonyl group, a sulfamido group, an oxycarbonyl group or a cyano group.

In general formula (C-I), when $R^{33}$ and $R^{32}$ are not linked to form a cyclic group, preferably $R^{32}$ represents a substituted or unsubstituted alkyl group or aryl group, particularly preferably an alkyl group substituted with a substituted aryloxy group; and $R^{33}$ preferably represents a hydrogen atom.

In general formula (C-II), preferably $R^{34}$ represents a sustituted or unsubstituted alkyl group or aryl group; and more preferably an alkyl group substituted with a substituted aryloxy group.

In general formula (C-II), preferably $R^{35}$ represents an alkyl group having 2 to 15 carbon atoms or a methyl group having a substituent containing 1 or more carbon atoms, which substituent is preferably an arylthio group, an alkylthio group, an acylamino group, an aryloxy group or an alkyloxy group.

In general formula (C-II), preferably $R^{36}$ represents an alkyl group having 2 to 15 carbon atoms; and particularly preferably an alkyl group having 2 to 4 carbon atoms.

In general formula (C-II), preferably $R^{35}$ represents a hydrogen atom or a halogen atom; and particularly preferably a chlorine atom or a fluorine atom.

In general formula (C-I), preferably $Z^1$ and $R^{32}$ each arepresents a hydrogen atom, a halogen atom, an alkoxy group, an aryloxy group, an acyloxy group or a sulfonamido group.

In general formula (C-II), more preferably $Z^2$ represents a halogen atom, particularly preferably a chlorine atom or a fluorine atom.

In general formula (C-I), more preferably $Z^1$ represents a halogen atom, particularly preferably a chlorine atom or a fluorine atom.

Specific examples of cyan couplers represented by general formulae (C-I) and (C-II) are given below, but the invention is not to be construed as limited to these compounds.

(C-1)

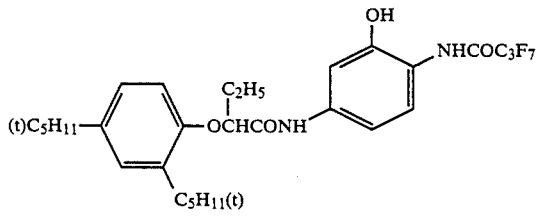

(C-2)

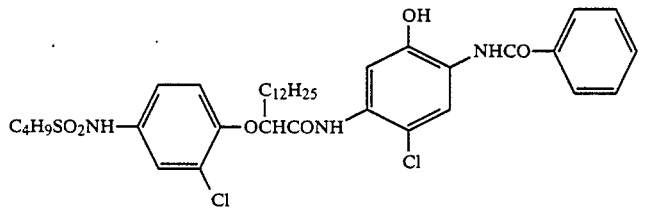

(C-3)

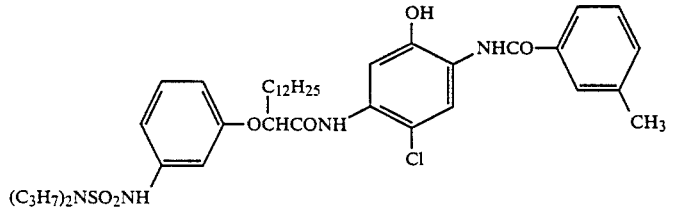

-continued
(C-4)
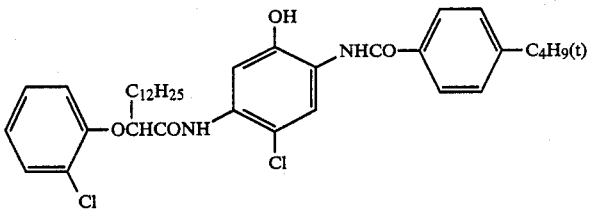
(C-5)
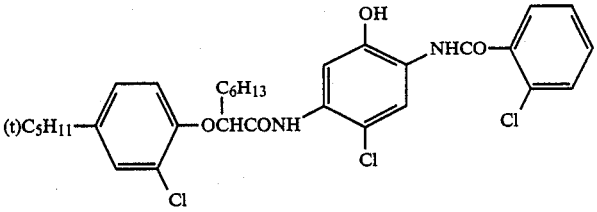
(C-6)
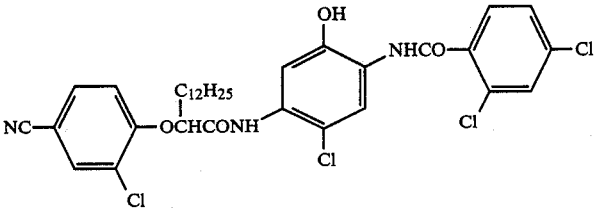
(C-7)
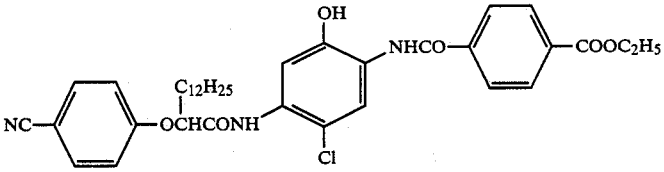
(C-8)
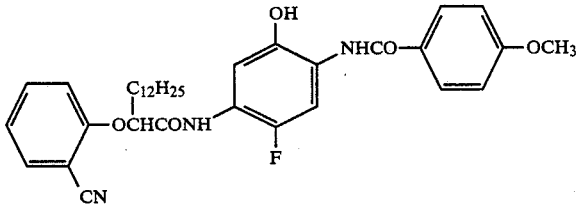
(C-9)
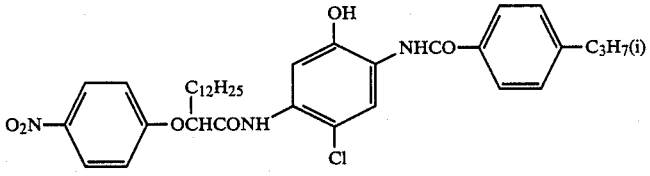
(C-10)
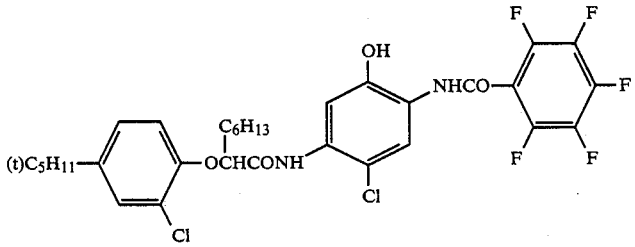

-continued
(C-11)
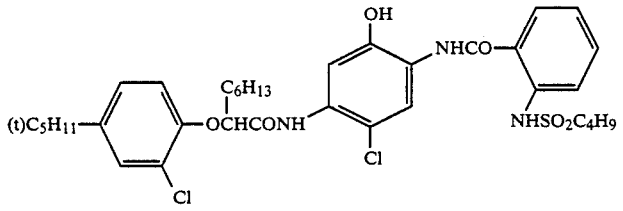
(C-12)
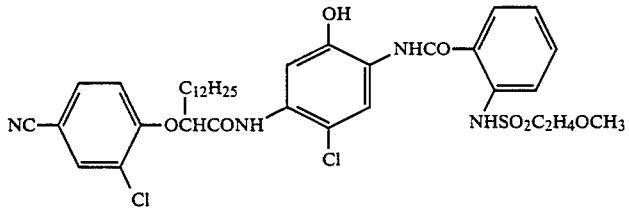
(C-13)
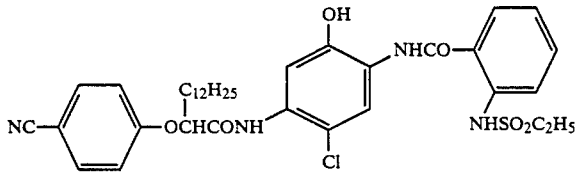
(C-14)
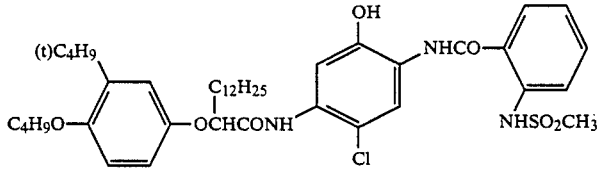
(C-15)
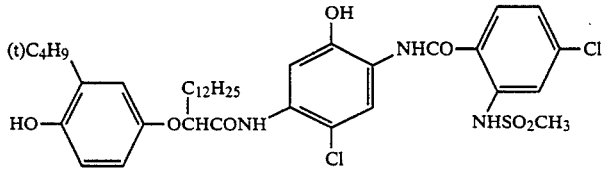
(C-16)
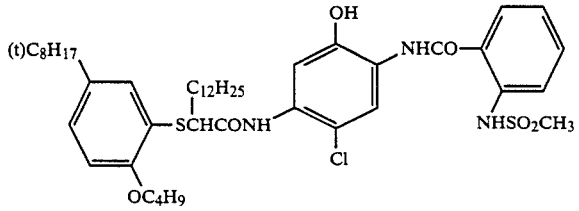
(C-17)
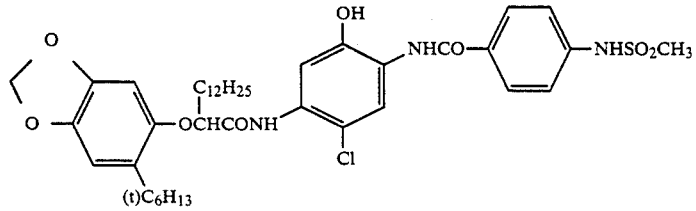

-continued
(C-18)
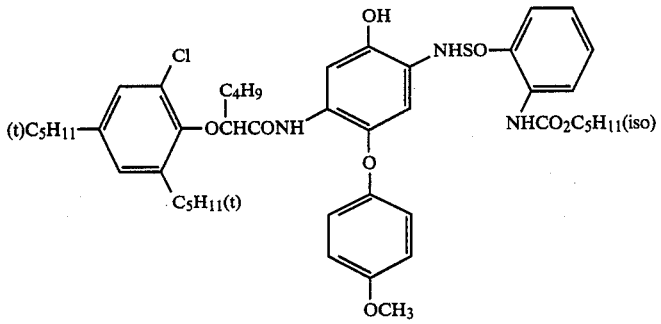
(C-19)
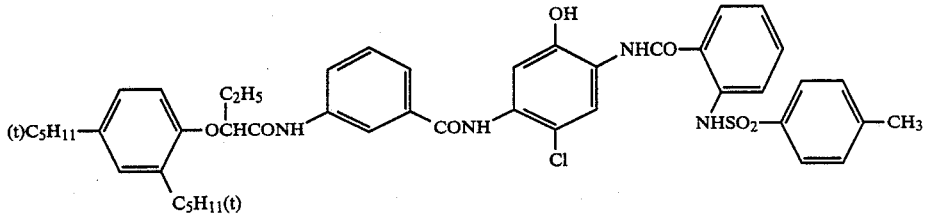
(C-20)
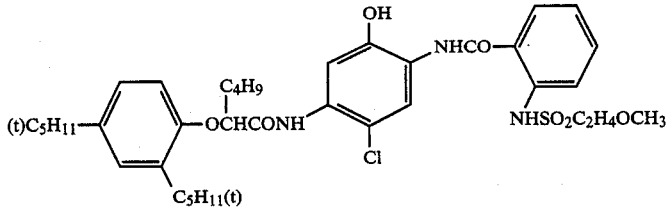
(C-21)
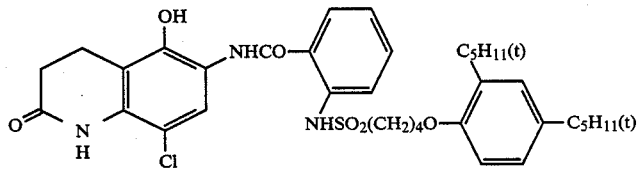
(C-22)
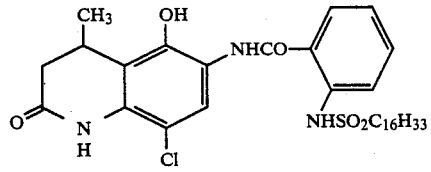
(C-23)
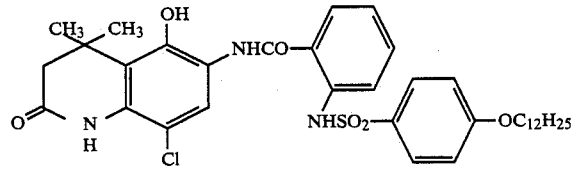
(C-24)
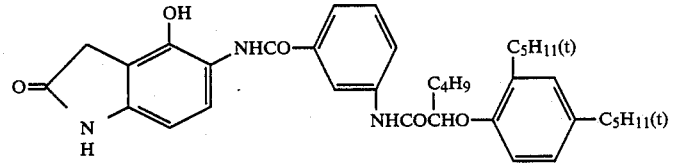

-continued
(C-25)
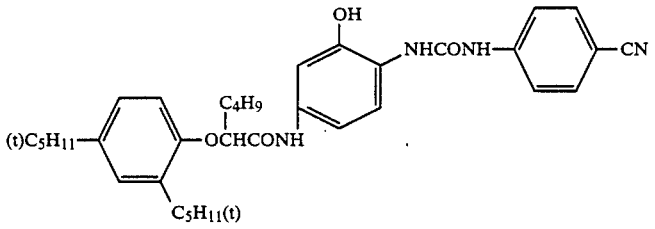
(C-26)
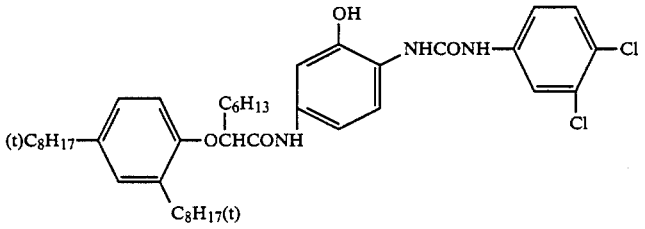
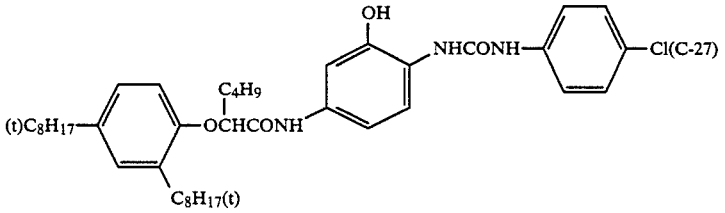
(C-28)
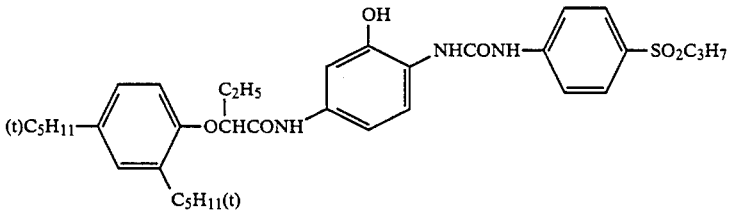
(C-29)
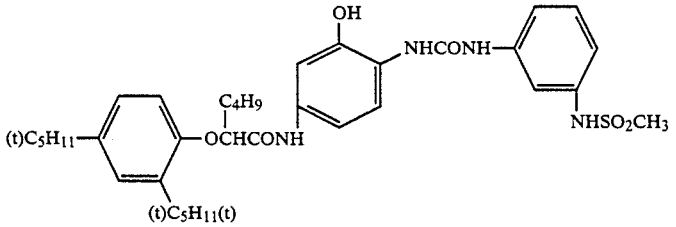
(C-30)
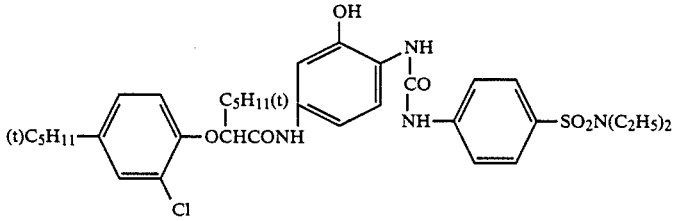
(C-31)
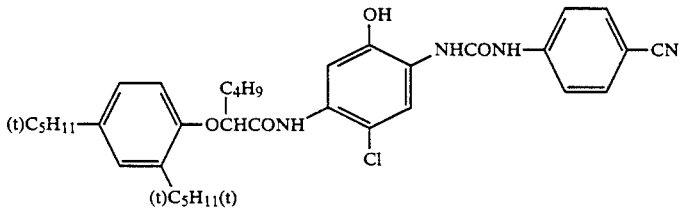

-continued
(C-32)
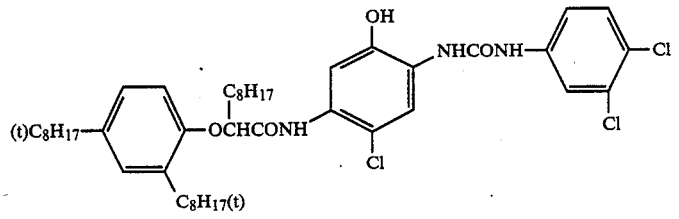
(C-33)
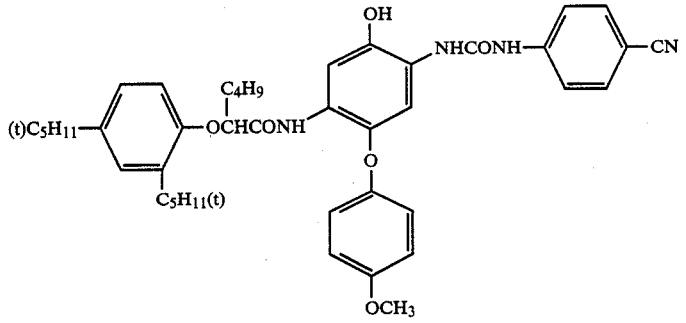
(C-34)
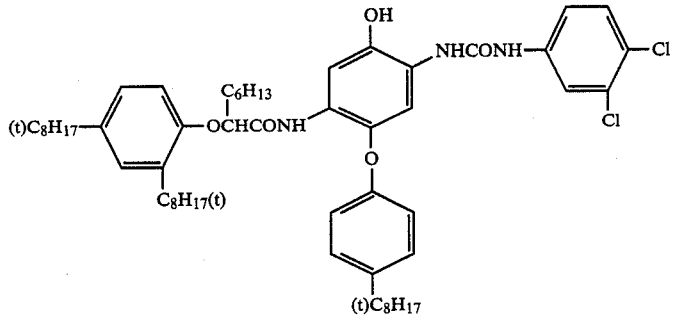
(C-35)
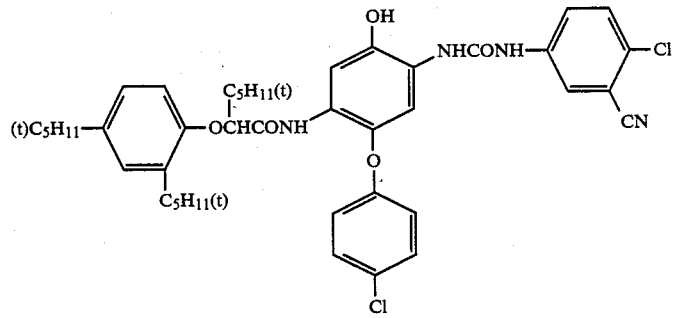
(C-36)
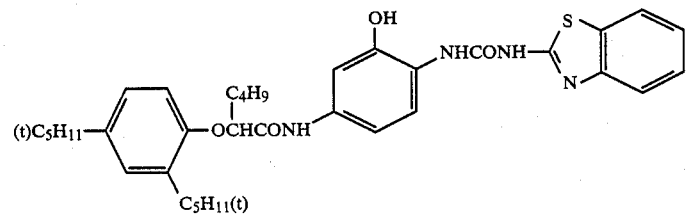

-continued
(C-37)
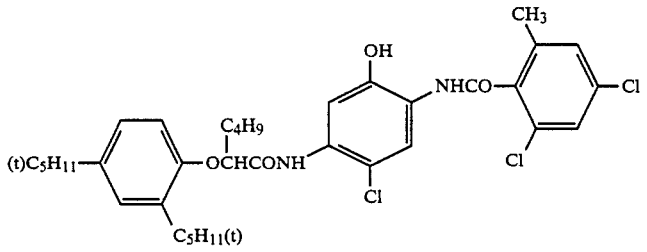
(C-38)
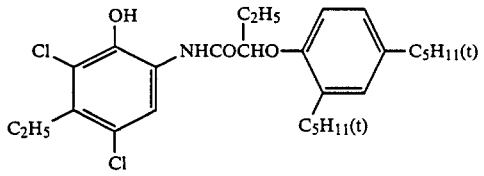
(C-39)
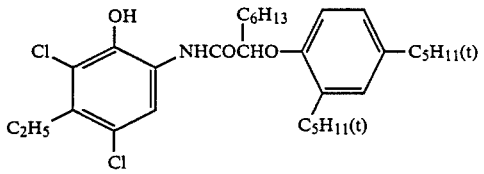
(C-40)
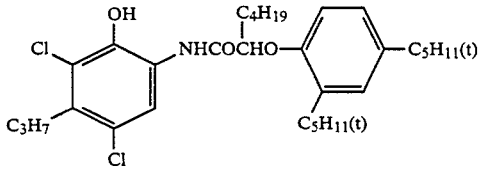
(C-41)
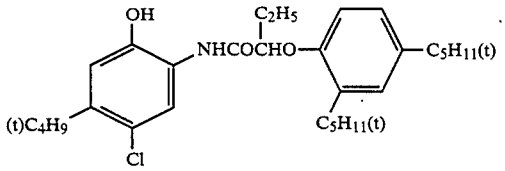
(C-42)
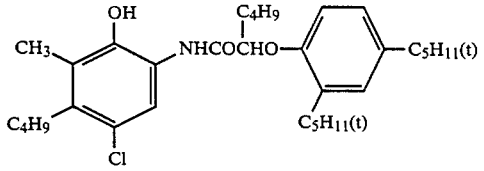
(C-43)
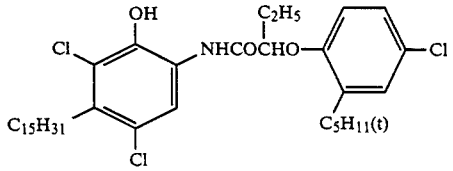
(C-44)
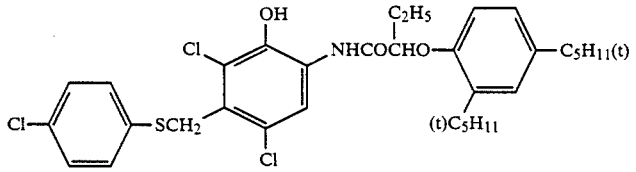

-continued
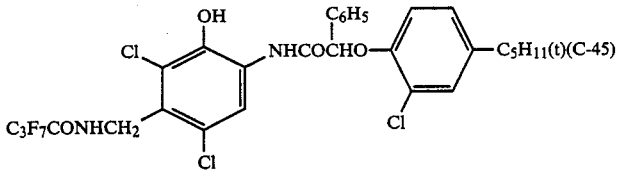
(C-46)
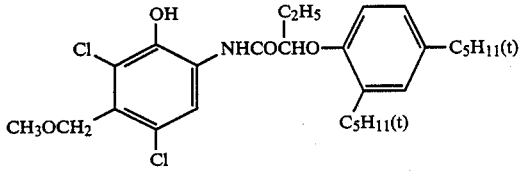
(C-47)
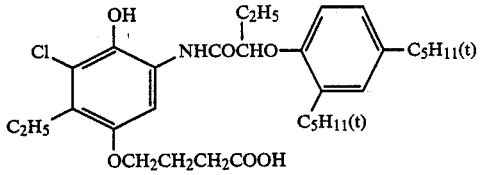
(C-48)
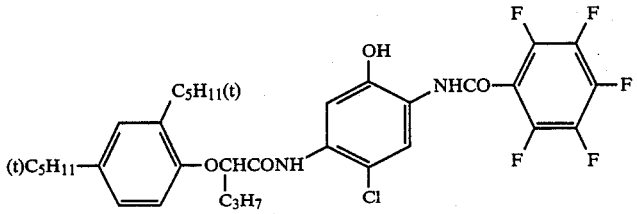
(C-49)
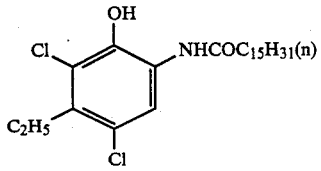
(C-50)
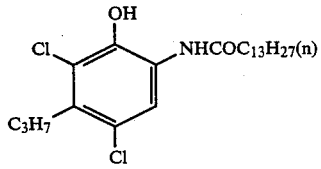
(C-51)
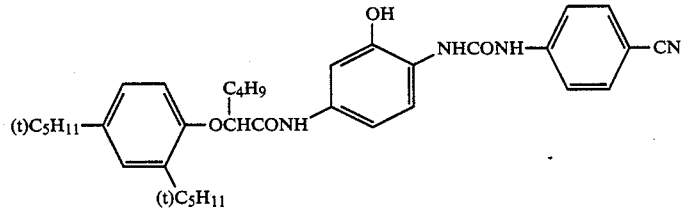
(C-52)
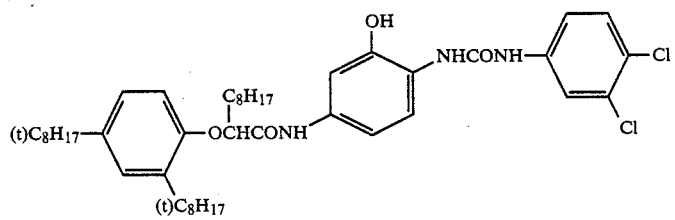

-continued
(C-53)
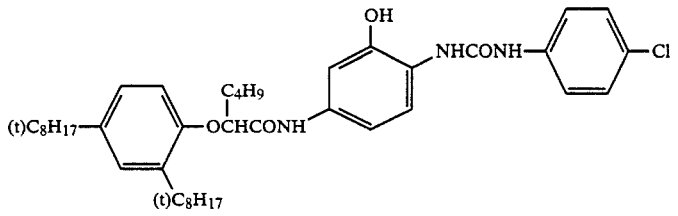
(C-54)
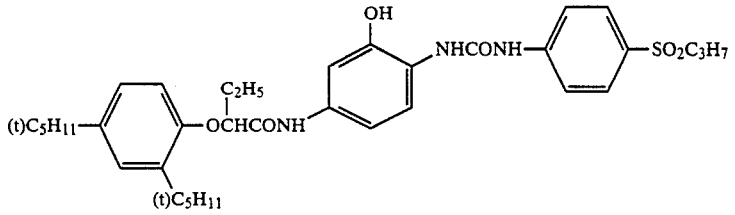
(C-55)
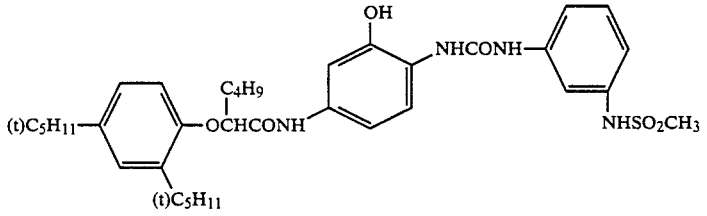
(C-56)
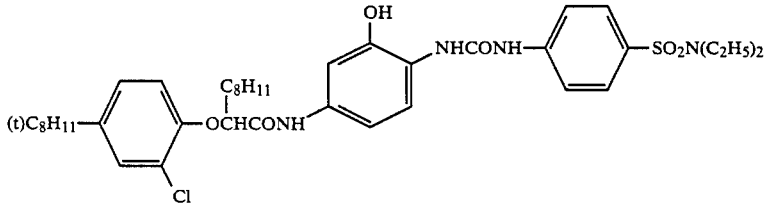
(C-57)
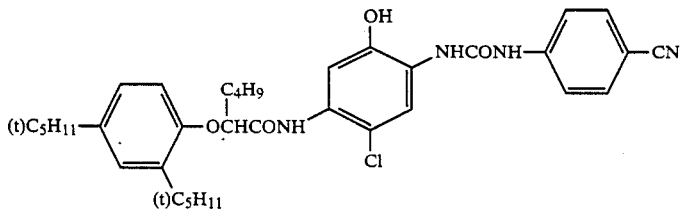
(C-58)
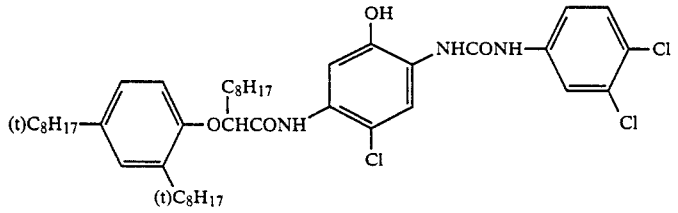

-continued (C-59)

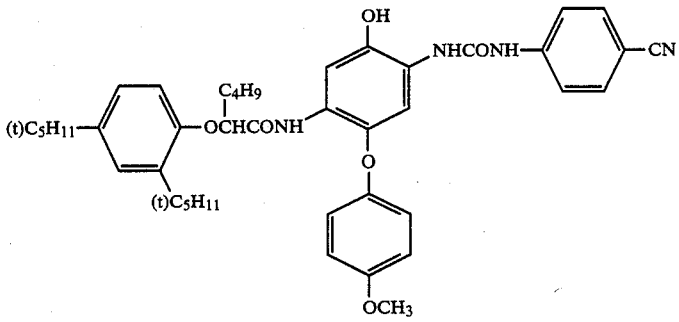

(C-60)

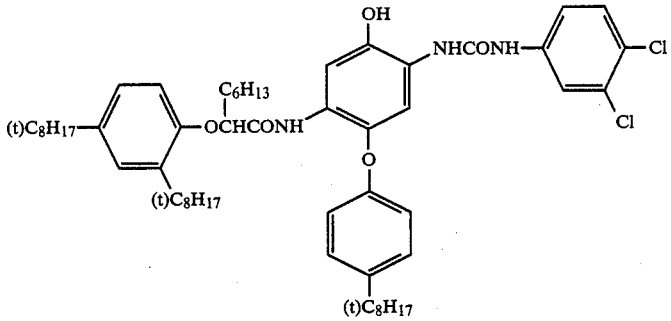

(C-61)

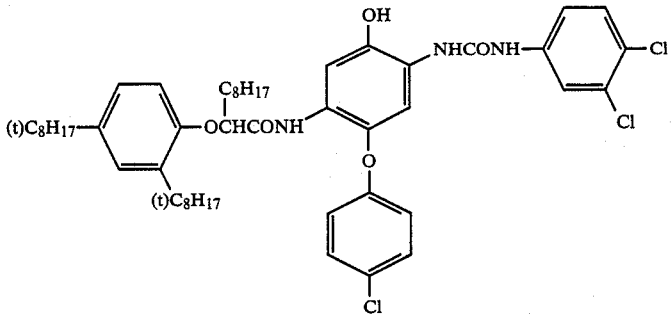

(C-62)

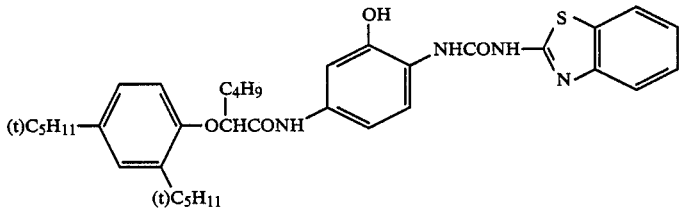

Cyan couplers represented by general formulae (C-I) and (C-II) can be synthesized, for example, by the methods described in Japanese patent application (OPI) No. 166956/84 and Japanese Patent Publication No. 11572/74.

Couplers that produce developed color dyes exhibiting suitable diffusibility also can be used to improve graininess. Examples of such dye diffusing couplers are described in U.S. Pat. No. 4,366,237 and British Pat. No. 2,125,570; examples of magenta couplers are described in European Pat. No. 96,570; and examples of yellow, magenta or cyan couplers are described in West German Offenlegungsschrift No. 3,234,533.

Dye-forming couplers and the above special couplers may form a dimer or more higher polymer. Typical examples of polymerized dye-forming couplers are described in U.S. Pat. Nos. 3,451,820 and 4,080,211. Specific examples of polymerized magenta couplers are described in British Pat. No. 2,102,173 and U.S. Pat. No. 4,367,282.

To satisfy properties required for a photographic material, two types of the above-described couplers can be used in the same photosensitive layer, or the same compound can be introduced into two or more layers.

The couplers used in the present invention are incorporated into a photosensitive material by an oil-in-water dispersion method. In the oil-in-water dispersion method, the coupler is dissolved in a high boiling organic solvent having a boiling point of at least 175° C. and/or a so-called auxiliary solvent having low boiling point, and then finely dispersed in water or an aqueous medium such as an aqueous gelatin solution in the existence of a surface active agent as the solution thereof. Examples of the high boiling point organic solvent are described in U.S. Pat. No. 2,322,027, etc.

The formation of the dispersion may be accomplished with phase inversion. The auxiliary solvent may be removed or reduced by distillation, noodle washing, or ultrafiltration, before the dispersion of the coupler is coated.

Specific examples of the high boiling point organic solvent which is used for dispersing the couplers in this invention include phthalic acid esters (e.g., dibutyl phthalate, dicyclohexyl phthalate, di-2-ethylhexyl phthalate, decyl phthalate, etc.), phosphoric acid esters or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenylphosphate, etc.), benzoic acid esters (e.g., 2-ethylhexyl benzoate, dodecyl benzoate, 2-ethylhexyl-p-hydroxy benzoate, etc.), amides (e.g., diethyldecanamide, N-tetradecylpyrazolidone, etc.), alcohols or phenols (e.g., isostearyl alcohol, 2,4-di-tert-amylphenol, etc.), aliphatic carboxylic acid esters (e.g., dioctyl azerate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

In this invention, an organic solvent having low boiling point of at least about 30° C., and preferably from about 50° C. to about 160° C., can be used as auxiliary solvent as described above. Specific examples of the low boiling organic solvent are ethyl acetate, butyl acetate, ethyl propionate, methyl ethyl ketone, cyclohexanone, 2-ethoxyethyl acetate, dimethylformamide, etc.

The steps and effects of the latex dispersion method and specific examples of latex for impregnation are described in U.S. Pat. No. 4,199,363, West German patent application (OLS) Nos. 2,541,274, 2,541,230, etc.

Generally, the amount of couplers used is about 0.001 to 1 mol per mol of a photosensitive silver halide. Preferably in the case of a yellow coupler the amount is about 0.01 to 0.5 mol per mol of a photosensitive silver halide; in the case of a magenta coupler the amount is about 0.003 to 0.3 mol per mol of a photosensitive silver halide; and in the case of a cyan coupler the amount is about 0.002 to 0.3 mol per mol of a photosensitive silver halide.

The photographic material processed by the present invention may contain, as a color fogging preventing agent or a color mixing preventing agent, any of conventional hydroquinone derivatives, aminophenol derivatives, amines, gallic acid derivatives, catechol derivatives, ascorbic acid derivatives, colorless couplers and sulfonamidophenol derivatives.

In the photosensitive material processed by the present invention, a known fading preventing agent can be used. Typical examples of organic fading preventing agents include hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines and ether or ester derivatives of these compounds obtained by silylating or alkylating the phenolic hydroxyl group of these compounds. Further, metal complexes such as (bissalicylaldoxyimato)nickel; complex and (bis-N,N-dialkyldithiocarbamato)nickel complexes can be used.

To prevent the yellow dye image from being deteriorated by heat, humidity or light, compounds having both a hindered amine structure and a hindered phenol structure in the same molecule as described in U.S. Pat. No. 4,268,593 give good results. To prevent the magenta dye image from being deteriorated, particularly by light, spiroindanes described in Japanese patent application (OPI) No. 159644/81 and hydroquinone-diethersubstituted or hydroqunone-monoether-substituted chromans described in Japanese Patent Application (OPI) No. 89835/80 are preferably used.

To improve shelf stability and particularly light fastness of the cyan image, a benzotriazole type ultraviolet absorbent is also preferably used. This ultraviolet absorbent may be coemulsified with a cyan coupler.

The coating amount of the ultraviolet absorbent is an amount sufficient to provide the cyan dye image with light stability, not so high as to cause the unexposed part (white part) of a color photographic paper to yellow. The coating amount is generally in the range of about $1\times10^{-4}$ mol/m$^2$ to $2\times10^{-3}$ mol/m$^2$, more preferably about $5\times10^{-4}$ mol/m$^2$ to $1.5\times10^{-3}$ mol/m$^2$.

In the photosensitive layer structure of a typical color paper, one and preferably both, of the layers adjacent to a cyan coupler-containing red-sensitive sensitive emulsion layer contain an ultraviolet absorbent. When an ultraviolet absorbent is added to an intermediate layer between a green-sensitive layer and a red-sensitive layer, it may be coemulsified with a color mixing preventing agent. When an ultraviolet absorbent is added to a protective layer, another protective layer as an outermost layer may be applied. In this protective layer, a matting agent having an desired particle diameter may be included.

In the photosensitive material to which the present invention is applied, the ultraviolet absorbent can be added to a hydrophilic colloid layer.

In the photosensitive material used in the present invention, for the purpose of prevention of irradiation or halation or for other purposes, a water-soluble dye may be included as a filter dye in a hydrophilic colloid layer. Oxonol type dyes, anthraquionone type dyes or azo type dyes are preferably used for these purposes, and oxonol dyes that absorb green light and red light are particularly preferred.

The photographic emulsion layer or other hydrophilic colloid layers of the photosensitive material used in the present invention may contain stilbene type brightening agents, triazine type brightening agents, oxazole type brightening agents or cumarin type brightening agents. Water-soluble brightening agents may be used or water-insoluble brightening agents in the form of a dispersion may be used.

The present invention can be used to process a multilayer multicolor photographic material having at least two different spectral sensitivities on a base. Generally, a multilayer color photographic material has at least one red-sensitive emulsion layer, at least one green-sensitive emulsion layer and at least one blue-sensitive emulsion layer on a base. The order of the arrangement of these layers may be varied as desired. Each of these emulsion layers may be composed of two or more emulsion layers differing in sensitivity, and a nonphotosensitive layer may be present between two or more emulsion layers having the same sensitivity.

It is preferred that the photosensitive material used in the present invention, in addition to a silver halide emulsion layer, have suitable conventional auxiliary layers such as a protective layer, an intermediate layer, a filter layer, an antihalation layer and a backing layer.

As a binder or a protective colloid that can be used in the emulsion layer and the intermediate layers of the photosensitive material used in the present invention, gelatin is advantageously used, but other hydrophilic colloids can be used.

For example, proteins such as gelatin derivatives, graft polymers of gelatin with other polymers, albumin and casein; cellulose derivatives such as hydroxyethyl celluloses, carboxymethyl celluloses and cellulose sulfates, sugar derivatives such as sodium alginate and starch derivatives; and various synthetic hydrophilic polymers such as homopolymers or copolymers, for example, polyvinyl alcohols, polyvinyl alcohol partial acetals, poly-N-vinylpyrrolidones, polyacrylic acids, polymethacrylic acids, polyacrylamides, polyvinylimidazoles and polyvinylpyrazoles can be used. It is particularly useful to use acrylic acid-modified polyvinyl alcohols in a protective layer when an emulsion having a high silver halide content is to be processed by rapid processing.

Useful gelatins include lime-processed gelatins, acid-processed gelatins and enzyme-processed gelatins as described in *Bull. Soc. Sci. Phot. Japan,* No. 16, page 30 (1966). Hydrolyzates and enzymolyzates of gelatin can also be used.

To the photosensitive material processed by the present invention may be added, in addition to the above additives, various conventional stabilizers, stain preventives, developers or their precursors, the abovementioned development accelerators and their precursors, lubricants, mordants, matting agents, antistatic agents, plasticizers or other additives. Typical examples of these additives are described in *Research Disclosure,* No. 17643 (December, 1978) and *Research Disclosure,* No. 18716 (November, 1979).

In photographic papers, the support is preferably a reflective base that increases the reflectivity and makes clear the dye image formed in a silver halide emulsion layer. Such reflective bases include a base coated with a hydrophobic resin containing a light reflecting material dispersed therein such as titanium oxide, zinc oxide, calcium carbonate and calcium sulfate. For example, baryta paper, polyethylene-coated paper, polypropylene type synthetic paper, a transparent base (e.g., glass plate, film of polyesters such as polyethylene terephthalate, cellulose triacetate and cellulose nitrate, polyamide film, polycarbonate film and polystyrene film) having a reflective layer or a reflecting material can be suitably selected according to the application.

The invention will now be explained in greater detail and with reference to the following Examples, but the present invention is not to be construed as being limited thereto. Unless otherwise indicated, all parts, percents and ratios are by weight.

EXAMPLE 1

The following color developing solution was prepared.

| Color Developing Solution | |
|---|---|
| Compound (A) | Given in Table 1 |
| Compound (B) | Given in Table 1 |
| Sodium sulfite | 0.2 g |
| Potassium carbonate | 30 g |
| EDTA.2Na | 1 g |
| Sodium chloride | 1.5 g |
| 4-Amino-3-methyl-N—ethyl-N—[β-(methanesulfonamido)ethyl]-p-phenylenediamine sulfate | 5.0 g |
| Brightener (4,4'-diaminostilbene UVITEX-CK, manufactured by Ciba-Geigy) | 3.0 g |
| Water to make | 1,000 ml |
| pH adjusted to 10.05 using KOH and $H_2SO_4$ | |

The thus prepared samples (Nos. 1 to 20) of color developing solutions were introduced into open test tubes such that the opening ratio (opening area/sample volume) was 0.06 $cm^{-1}$, and were allowed to stand at 35° C. for 4 weeks. Thereafter, the amount lost due to evaporation was replaced with distilled water, and the remaining ratio of the aromatic primary amine color developing agent was determined by liquid chromatography.

As is apparent from Table 1, in contrast when only hydroxylamine or diethylhydroxylamine (Sample Nos. 1 and 2) was used, when compounds such as triethanolamine, polyethyleneimine or sodium sulfite also were present, the ratio of the developing agent remaining could be increased, although not to a satisfactory extent (Sample Nos. 3, 4 and 5).

However, as is apparent from Sample Nos. 6 to 20, when compounds represented by general formula (Ia) were added to the developing solution, the ratio of the developing agent remaining was remarkably improved, demonstrating the improvement in the preservability of the color developing solution.

Particularly, as is apparent from Sample Nos. 11 and 12, the combination of a compound represented by general formula (Ia) and hydroxylamine compound II-(5) remarkably improved preservability.

TABLE 1

| Sample No. | Compound (A)*1 (0.03 mol/l) | Compound (B)*2 (0.04 mol/l) | Developing Solution | Remaining*3 Ratio of Developing Agent (%) |
|---|---|---|---|---|
| 1 | — | II-(34) | Comparison | 5 |
| 2 | — | II-(33) | " | 12 |
| 3 | Triethanolamine | II-(34) | " | 71 |
| 4 | Polyethyleneimine*4 | " | " | 59 |
| 5 | $Na_2SO_3$ | " | " | 72 |
| 6 | (Ia)-1 | " | Invention | 88 |
| 7 | (Ia)-2 | " | " | 87 |
| 8 | (Ia)-5 | " | " | 87 |
| 9 | (Ia)-1 | II-(33) | " | 94 |
| 10 | (Ia)-2 | " | " | 92 |

TABLE 1-continued

| Sample No. | Compound (A)*1 (0.03 mol/l) | Compound (B)*2 (0.04 mol/l) | Developing Solution | Remaining*3 Ratio of Developing Agent (%) |
|---|---|---|---|---|
| 11 | (Ia)-5 | " | " | 92 |
| 12 | (Ia)-17 | " | " | 90 |
| 13 | (Ia)-1 | II-(5) | " | 97 |
| 14 | (Ia)-2 | " | " | 95 |
| 15 | (Ia)-5 | " | " | 95 |
| 16 | (Ia)-17 | " | " | 94 |
| 17 | (Ia)-1 | (a) | " | 92 |
| 18 | (Ia)-1 | (b) | " | 90 |
| 19 | (Ia)-1 | (c) | " | 99 |
| 20 | (Ia)-1 | (d) | " | 93 |

*1Each reference numeral denotes an exemplified compound with the same reference numeral given above.
*2Each reference numeral denotes an exemplified compound with the same reference numeral given above or the compound with a reference numeral given in Table A-(1) below.
*3Remaining ratio of developing agent $$= \frac{\text{Concentration of remaining developing agent}}{5.0\ g/l} \times 100$$

*4$\leftarrow CH_2CH_2NH \rightarrow_n$ n = 500 ~ 2,000

TABLE A-(1)

| Compound (B) | Structural Formula |
|---|---|
| (a) | $C_4H_9OC(=O)-NHOH$ |
| (b) | D-glucose |
| (c) | $(C_2H_5)_2NNH_2.HCl$ |
| (d) | 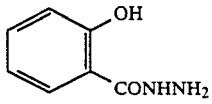 |

*1Opening ratio by opening area/volume of sample, and is 0.06 $cm^{-1}$ in the present invention.
*2Each compound is indicated by the reference numeral of the preferred exemplified compound given above.
*3Each compound is indicated by the reference numeral of the preferred exemplified compound given above or by the designation of the compound given in Table A-(2).
*4Given by $\neq \frac{\text{Concentration of remaining developing agent}}{5.0\ g/l} \times 100$
*5$\leftarrow CH_2CH_2NH \rightarrow_n$ n = 500 ~ 2,000

EXAMPLE 2

The color developing solutions used in Example 1 were used. In the same manner as in Example 1, the remaining ratio of the aromatic primary amine color developing agent was determined. The results are given in Table 2.

As is apparent from Table 2, in contrast to the developing solution containing only hydroxylamine or diethylhydroxylamine (Sample Nos. 1 and 2), when compounds such as triethanolamine, polyethyleneimine or sodium sulfite were also prevent, the ratio of the developing agent remaining could be increased, but to an insufficient extent (Sample Nos. 3, 4 and 5). However, when compounds according to the invention were used, the preservability of the developing agent could be improved (Sample Nos. 6 to 20), and in particular, when the hydroxylamine II-(33) was added, the preservability was remarkably improved (Sample Nos. 11 and 12).

These results demonstrate the surprising superiority of the invention combination, in contrast to triethanolamine, sodium sulfite and polyethyleneimine, in improving the stability of the color developing agent.

TABLE 2

| Sample No. | Compound (A)*2 (0.03 mol/l) | Compound (B)*3 (0.04 mol/l) | Remaining*4 Ratio of Developing Agent (%) | Developing Solution |
|---|---|---|---|---|
| 1 | — | II-(34) | 5 | Comparison |
| 2 | — | II-(33) | 12 | Comparison |
| 3 | Triethanolamine | II-(34) | 71 | Comparison |
| 4 | Polyethylene-imine*5 | II-(34) | 59 | Comparison |
| 5 | $Na_2SO_3$ | II-(34) | 72 | Comparison |
| 6 | (Ib)-1 | II-(34) | 86 | Invention |
| 7 | (Ib)-3 | II-(34) | 85 | Invention |
| 8 | (Ib)-7 | II-(34) | 84 | Invention |
| 9 | (Ib)-1 | II-(33) | 95 | Invention |
| 10 | (Ib)-3 | II-(33) | 94 | Invention |
| 11 | (Ib)-1 | II-(5) | 98 | Invention |
| 12 | (Ib)-3 | II-(5) | 97 | Invention |
| 13 | (Ib)-1 | (a) | 93 | Invention |
| 14 | (Ib)-3 | (a) | 92 | Invention |
| 15 | (Ib)-1 | (b) | 87 | Invention |
| 16 | (Ib)-3 | (b) | 86 | Invention |
| 17 | (Ib)-1 | (c) | 99 | Invention |
| 18 | (Ib)-3 | (c) | 99 | Invention |
| 19 | (Ib)-1 | (d) | 95 | Invention |
| 20 | (Ib)-3 | (d) | 94 | Invention |

TABLE A-(2)

| Compound (B) | Structural Formula |
|---|---|
| II-(5) | $(CH_3O\leftarrow CH_2)_2N-OH.(CH_2COOH)_2$ |
| (a) | $C_4H_9OC(=O)-NHOH$ |
| (b) | D-glucose |
| (c) | $(C_2H_5)_2NNH_2.HCl$ |

TABLE A-(2)-continued

| Compound (B) | Structural Formula |
|---|---|
| (d) | 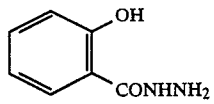 |

EXAMPLE 3

A paper base having opposite surfaces laminated with polyethylene was coated with layers having compositions shown in Table B below, to prepare a multilayer color photographic paper. The coating composition of each layer was prepared as described below. The structures of the couplers, the dye stabilizers, and other compounds used in the coating liquids are given below.

Preparation of the First Coating Liquid 27.2 ml of ethyl acetate and 7.9 ml of solvent (c) were added to 19.1 g of yellow coupler (a) and 4.4 g of dye stabilizer (b) to dissolve them, and the solution was emulsified and dispersed into 185 ml of a 10% aqueous gelatin solution containing 8 ml of a 10% aqueous solution of sodium dodecylbenzenesulfonate. Separately, a blue spectral sensitizing dye shown below was added to a silver chlorobromide emulsion (silver bromide: 1 mol %, Ag content: 70 g/kg) in an amount of $5.0\times10^{-4}$ mol per mol of silver chlorobromide to prepare 90 g of a blue-sensitive emulsion. The emulsified dispersion and the emulsion were mixed and dissolved to prepare the first layer coating liquid, with a gelatin concentration adjusted to have the composition shown in Table B. In a similar manner to the first coating liquid, using constituents shown in Table B, the second layer to the seventh layer were prepared and coated. As a gelatin hardening agent, 1-oxy-3,5-dichloro-s-triazine sodium salt was added to each layer. The spectral sensitizers used for the respective emulsion layers are shown below.

(a) Spectral Sensitizer for Blue-Sensitive Emulsion Layer

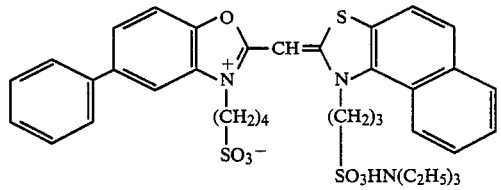

($7\times10^{-4}$ mol was added per mol of silver halide)

(b) Spectral Sensitizer for Green-Sensitive Emulsion Layer

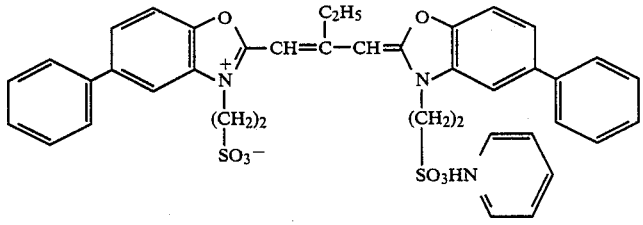

($4\times10^{-4}$ mol was added per mol of silver halide)

(c) Spectral Sensitizer for Red-Sensitive Emulsion Layer

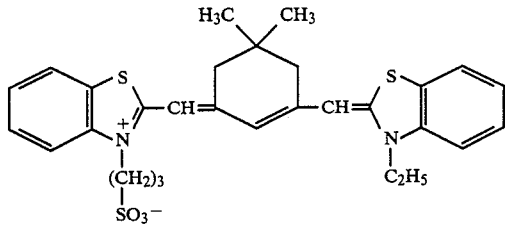

($2\times10^{-4}$ mol was added per mol of silver halide)

The following dyes were used as irradiation preventing dyes in emulsion layers.

In the Green-Sensitive Emulsion Layer:

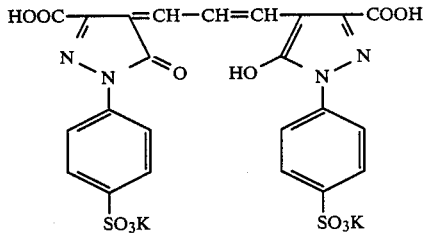

(containing 10 mg/m$^2$)

In the Red-Sensitive Emulsion Layer:

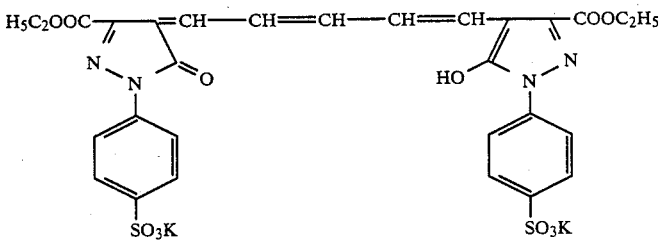

(containing 5 mg/m$^2$)
The structural formulae of compounds including couplers used herein are given below:
(a) Yellow Coupler
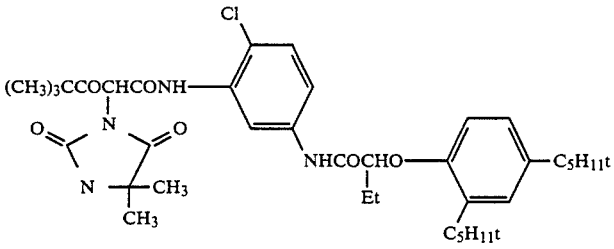
(b) Dye Image Stabilizer
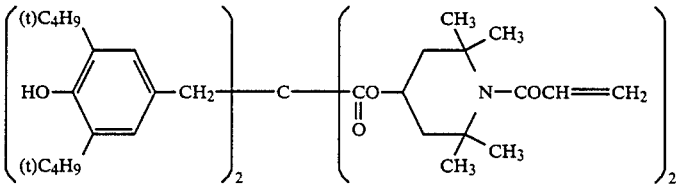
(c) Solvent
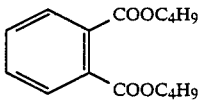
(d) Color Mixing Preventing Agent
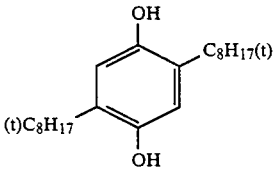
(e) Magenta Coupler
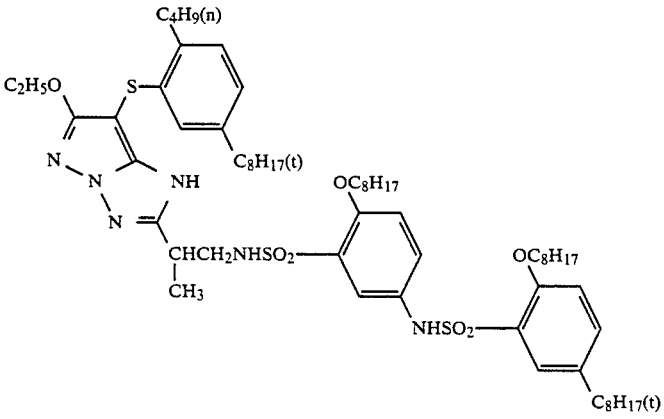
(f) Dye Image Stabilizer
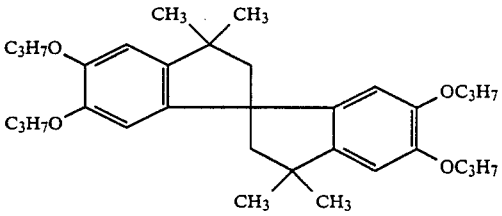
(g) Solvent
2:1 (weight ratio) mixture of
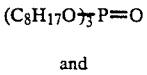
and
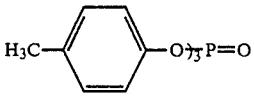
(h) Ultraviolet Absorbent
1:5:3 (molar ratio) mixture of

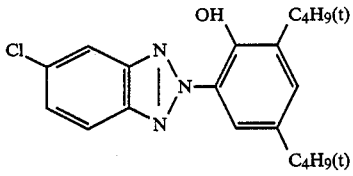

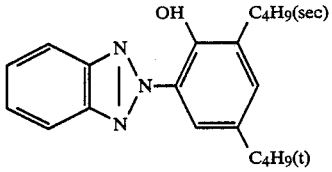

and

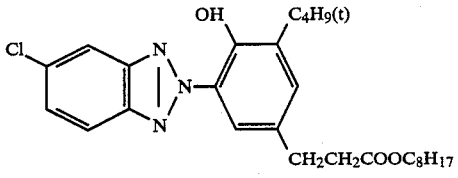

(i) Color Mixing Preventing Agent

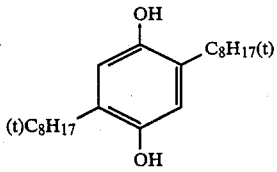

(j) Solvent $(iso\text{-}C_9H_{18}O)_3p{=}O$ (k) Cyan Coupler

1:1 (molar ratio) mixture of

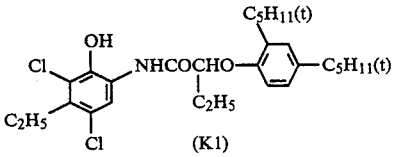

(K1)

and

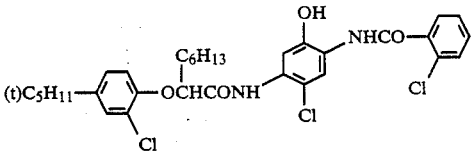

(K2)

(l) Dye Image Stabilizer

1:3:3 (molar ratio) mixture of

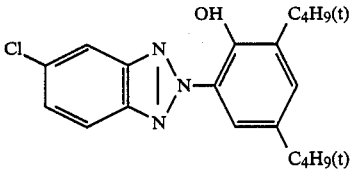

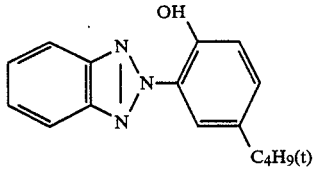

and

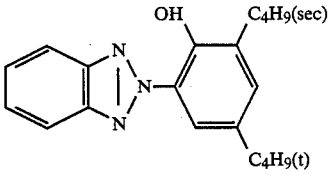

(m) Solvent

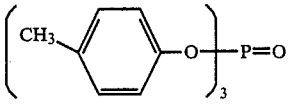

TABLE B

| | |
|---|---|
| Seventh Layer: Protective Layer | |
| Gelatin | 1.33 g/m$^2$ |
| Acryl-modified copolymer of polyvinyl alcohol (degree of modification: 17%) | 0.17 g/m$^2$ |
| Sixth Layer: Ultraviolet Absorbing Layer | |
| Gelatin | 0.54 g/m$^2$ |
| Ultraviolet Absorbent (h) | 0.21 g/m$^2$ |
| Solvent (j) | 0.09 cc/m$^2$ |
| Fifth Layer: Red-Sensitive Layer | |
| Silver chlorobromide emulsion (silver bromide: 0.5 mol %) | 0.26 g/m$^2$ |
| Gelatin | 0.98 g/m$^2$ |
| Cyan coupler (k) | 0.38 g/m$^2$ |
| Dye image stabilizer (l) | 0.17 g/m$^2$ |
| Solvent (m) | 0.23 cc/m$^2$ |
| Fourth Layer: Ultraviolet Absorbing Layer | |
| Gelatin | 1.60 g/m$^2$ |
| Ultraviolet absorbent (h) | 0.62 g/m$^2$ |
| Color mixing preventing agent (i) | 0.05 g/m$^2$ |
| Solvent (j) | 0.26 cc/m$^2$ |
| Third Layer: Green-Sensitive Layer | |
| Silver chlorobromide emulsion (silver bromide: 0.5 mol %) | 0.16 g/m$^2$ |
| Gelatin | 1.80 g/m$^2$ |
| Magenta coupler (e) | 0.48 g/m$^2$ |
| Dye image stabilizer (f) | 0.20 g/m$^2$ |
| Solvent (g) | 0.68 cc/m$^2$ |
| Second Layer: Color Mixing Preventing Layer | |
| Gelatin | 0.99 g/m$^2$ |
| Color mixing preventing agent (d) | 0.08 g/m$^2$ |
| First Layer: Blue-Sensitive Layer | |
| Silver chlorobromide emulsion (silver bromide: 1 mol %) | 0.30 g/m$^2$ |
| Gelatin | 1.86 g/m$^2$ |
| Yellow coupler (a) | 0.82 g/m$^2$ |
| Dye image stabilizer (b) | 0.19 g/m$^2$ |

TABLE B-continued

| Solvent (c) | 0.34 cc/m$^2$ |
|---|---|

Base:
Polyethylene-laminated paper (the polyethylene on the first layer side contained a white pigment ($TiO_2$) and a bluish dye (ultramarine))

The color photographic paper obtained was exposed at 2,854° K. through a wedge at 250 CMS and subsequently processed by the following steps, in which the composition of the color developing solution was varied.

| Processing Step | Temperature (°C.) | Time (sec) |
|---|---|---|
| Color Developing | 35 | 45 |
| Bleach-Fix | 35 | 45 |
| Stabilizing (1) | 35 | 45 |
| Stabilizing (2) | 35 | 20 |
| Stabilizing (3) | 35 | 20 |
| Drying | 70–80 | 60 |

The stabilizing solutions were used in three-tank countercurrent washing, from stabilizing solution (3) to stabilizing solution (1). The processing solutions used were as follows:

| Color Developing Solution | |
|---|---|
| Additive C | See Table 3 |
| Additive D | See Table 3 |
| Benzyl alcohol | See Table 3 |
| Diethylene glycol | See Table 3 |
| Sodium sulfite | 0.2 g |
| Potassium carbonate | 30 g |
| Nitrilotriacetic acid | 1 g |
| Sodium chloride | 1.5 g |
| Color developing agent (see Table 3) | 0.01 mol |
| Brightener (4,4'-diaminostilbene) | 3.0 g |
| Potassium bromide | 0.01 g |
| Water to make | 1,000 ml |
| pH adjusted using KOH and $H_2SO_4$ to | 10.05 |
| **Bleach-Fix Solution** | |
| EDTA Fe(III)$NH_4$.$2H_2O$ | 60 g |
| EDTA.2Na.$2H_2O$ | 4 g |
| Ammonium thiosulfate (70% aq. soln.) | 120 ml |
| Sodium sulfite | 16 g |
| Glacial acetic acid | 7 g |
| Water to make | 1,000 ml |
| pH adjusted using KOH and $H_2SO_4$ to | 5.5 |
| **Stabilizing Solution** | |
| Formalin (37% aq. soln.) | 0.1 ml |
| 1-Hydroxyethylidene-1,1-diphosphonic acid (60% aq. soln.) | 1.6 ml |
| Bismuth chloride | 0.35 g |
| Ammonia water (26% aq. soln.) | 2.5 ml |
| Nitrilotriacetic acid.3Na | 1.0 g |
| EDTA.4H | 0.5 g |
| Sodium sulfite | 1.0 g |
| 5-Chloro-2-methyl-4-isothiazoline-3-one | 50 mg |
| Water to make | 1,000 ml |
| pH adjusted using KOH and $H_2SO_4$ to | 4.0 |

A portion of each of the above color developing solutions was placed in an open 1-liter beaker, was allowed to stand at 35° C. for 21 days, and then was used in the above processing steps, in an aged solution test.

Processing using the color developing solution (fresh solution) that had not been aged is referred to as a fresh solution test.

The photographic characteristics obtained by the fresh solution test and the aged test solution are shown in Table 3.

The photographic characteristics examined were the Dmin and the gradation in the magenta density.

Dmin is the minimum density, and the gradation is the change in density from a density of 0.5 to the density produced by an exposure higher by a factor of 0.3 log E.

From Table 3, it can be seen that in Experiments 1 to 4, Dmin and gradation changed with time, and contrast became high, while in Experiments 5 to 18, the change in Dmin and gradation with time was small, demonstrating the remarkable improvement in stability of photographic characteristics. Also, it is seen that in Experiments 5 to 8, the change in Dmin and gradation in Experiment 8 was small, and of the color developing agent, compound d was the best.

TABLE 3

| Experiment No. | Color* Developing Agent | Benzyl Alcohol/ Diethylene Glycol (ml/ml) | Additive C** (0.04 mol) | Additive D (0.03 mol) | Developing Solution | Frese Solution Dmin | Frese Solution Gradation | Aged Solution Dmin | Aged Solution Gradation |
|---|---|---|---|---|---|---|---|---|---|
| 1 | d | 15/10 | II-(33) | Triethanolamine | Comparison | 0.14 | 0.76 | 0.19 | 0.86 |
| 2 | " | — | " | " | " | 0.13 | 0.73 | 0.17 | 0.84 |
| 3 | " | — | " | Polyethyleneimine | " | 0.13 | 0.74 | 0.18 | 0.84 |
| 4 | " | — | II-(34) | Triethanolamine | " | 0.13 | 0.52 | 0.22 | 0.65 |
| 5 | a | — | II-(33) | (Ia)-1 | Invention | 0.13 | 0.64 | 0.15 | 0.69 |
| 6 | b | — | " | " | " | 0.13 | 0.73 | 0.15 | 0.78 |
| 7 | c | — | " | " | " | 0.13 | 0.73 | 0.15 | 0.79 |
| 8 | d | — | " | " | " | 0.13 | 0.72 | 0.13 | 0.73 |
| 9 | " | 15/10 | " | " | " | 0.13 | 0.76 | 0.16 | 0.78 |
| 10 | " | — | II-(5) | (Ia)-1 | " | 0.13 | 0.74 | 0.13 | 0.75 |
| 11 | " | — | " | (Ia)-2 | " | 0.13 | 0.74 | 0.14 | 0.76 |
| 12 | " | — | " | (Ia)-5 | " | 0.13 | 0.74 | 0.14 | 0.76 |
| 13 | " | — | (a) | (Ia)-1 | " | 0.13 | 0.73 | 0.14 | 0.76 |
| 14 | " | — | " | (Ia)-5 | " | 0.13 | 0.73 | 0.14 | 0.76 |
| 15 | " | — | (b) | (Ia)-1 | " | 0.13 | 0.76 | 0.14 | 0.78 |
| 16 | " | — | " | (Ia)-5 | " | 0.13 | 0.76 | 0.15 | 0.79 |
| 17 | " | — | (c) | (Ia)-1 | " | 0.13 | 0.72 | 0.13 | 0.72 |

TABLE 3-continued

| Experiment No. | Color* Developing Agent | Benzyl Alcohol/ Diethylene Glycol (ml/ml) | Additive C** (0.04 mol) | Additive D (0.03 mol) | Developing Solution | Frese Solution Dmin | Frese Solution Gradation | Aged Solution Dmin | Aged Solution Gradation |
|---|---|---|---|---|---|---|---|---|---|
| 18 | " | — | " | (Ia)-1 | " | 0.13 | 0.72 | 0.15 | 0.74 |

*Color Developing agents a to d were:

a

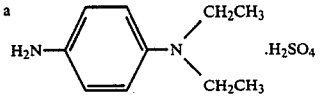

b

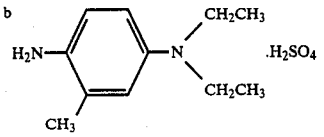

c

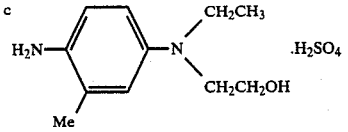

d

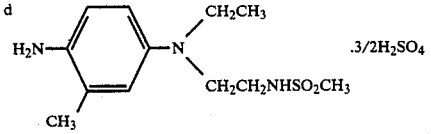

**Compounds (a), (b), (c) and (d) are the same as in Table A-(1).

EXAMPLE 4

Example 3 was repeated except that the spectral sensitizers given below were used in the coating liquids, to prepare a multilayer color photographic paper, and the color developing solutions were allowed to stand at 35° C. for 28 days instead of at 35° C. for 21 days.

In the Blue-Sensitive Emulsion Layer:

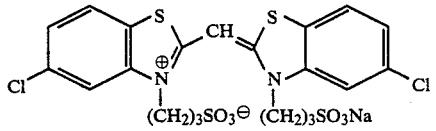

($5.0\times10^4$ mol was added per mol of silver halide)

In the Green-Sensitive Emulsion Layer:

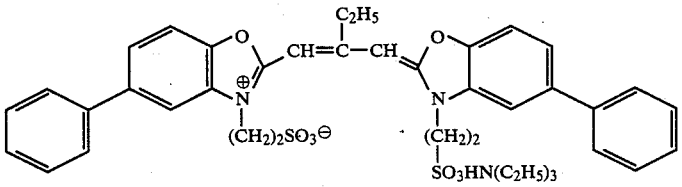

($4.0\times10^{-4}$ mol was added per mol of silver halide)

In the Red-Sensitive Emulsion Layer:

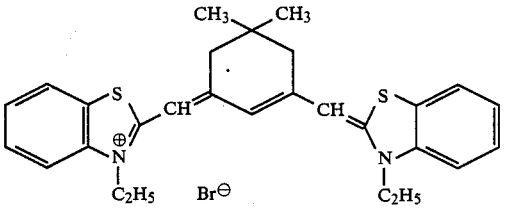

($1.0\times10^4$ mol was added per mol of silver halide)

The photographic characteristics obtained using the fresh solution and the aged solution in the same manner as in Example 3 are given in Table 4.

TABLE 4

| Experiment No. | Color Developing Agent | Benzyl Alcohol/ Diethylene Glycol (ml/ml) | Additive C (0.04 mol) | Additive D (0.03 mol) | Developing Solution | Fresh Solution Dmin | Fresh Solution Gradation | Aged Solution Dmin | Aged Solution Gradation |
|---|---|---|---|---|---|---|---|---|---|
| 1 | d | 15/10 | II-(33) | Triethanolamine | Comparison | 0.14 | 0.76 | 0.21 | 0.88 |
| 2 | d | — | II-(33) | Triethanolamine | Comparison | 0.13 | 0.73 | 0.19 | 0.86 |
| 3 | d | — | II-(33) | Polyethyleneimine | Comparison | 0.13 | 0.74 | 0.20 | 0.87 |
| 4 | d | — | II-(34) | Triethanolamine | Comparison | 0.13 | 0.52 | 0.24 | 0.69 |
| 5 | a | — | II-(33) | (Ib)-1 | Invention | 0.13 | 0.74 | 0.18 | 0.80 |
| 6 | b | — | II-(33) | (Ib)-1 | Invention | 0.13 | 0.74 | 0.18 | 0.81 |
| 7 | c | — | II-(33) | (Ib)-1 | Invention | 0.13 | 0.73 | 0.15 | 0.79 |
| 8 | d | — | II-(33) | (Ib)-1 | Invention | 0.13 | 0.72 | 0.13 | 0.72 |
| 9 | d | 15/10 | II-(33) | (Ib)-1 | Invention | 0.13 | 0.74 | 0.17 | 0.78 |

TABLE 4-continued

| Experiment No. | Color Developing Agent | Benzyl Alcohol/ Diethylene Glycol (ml/ml) | Additive C (0.04 mol) | Additive D (0.03 mol) | Developing Solution | Fresh Solution Dmin | Fresh Solution Gradation | Aged Solution Dmin | Aged Solution Gradation |
|---|---|---|---|---|---|---|---|---|---|
| 10 | a | — | II-(5) | (Ib)-1 | Invention | 0.13 | 0.75 | 0.18 | 0.81 |
| 11 | b | — | II-(5) | (Ib)-1 | Invention | 0.13 | 0.74 | 0.17 | 0.82 |
| 12 | c | — | II-(5) | (Ib)-1 | Invention | 0.13 | 0.74 | 0.15 | 0.79 |
| 13 | d | — | II-(5) | (Ib)-1 | Invention | 0.13 | 0.73 | 0.13 | 0.73 |
| 14 | d | 15/10 | II-(5) | (Ib)-1 | Invention | 0.13 | 0.75 | 0.16 | 0.81 |
| 15 | d | — | (c) | (Ib)-1 | Invention | 0.13 | 0.72 | 0.14 | 0.72 |
| 16 | d | — | (c) | (Ib)-3 | Invention | 0.13 | 0.72 | 0.15 | 0.73 |
| 17 | d | — | (d) | (Ib)-1 | Invention | 0.13 | 0.73 | 0.15 | 0.76 |
| 18 | d | — | (d) | (Ib)-3 | Invention | 0.13 | 0.73 | 0.15 | 0.76 |

(c) and (d) were described in Table A-(2) in Example 2.

In the comparative examples (Experiment Nos. 1 to 4), the increase in Dmin and the change in gradation were great, while in the present invention the change in photographic characteristics with time was small, and in particular, good results were obtained when color developing agents c and d were used. When benzyl alcohol was not present, the change in photographic characteristics was small and better results were obtained.

EXAMPLE 5

Example 3 was repeated, except that the bromide ion content of the green-sensitive emulsion layer was changed to 80 mol %, to prepare a color photographic paper. The color photographic paper was subjected to wedge exposure, and the changes in photographic characteristics were assessed, based on the occurrence of fogging when using the aged solution. In the case of the developing solution in the comparative examples, fogging increased greatly when the aged solution was used, while in the case of the aged solution of the developing solution according to the invention, the increase in fogging was small and good photographic characteristics were maintained.

EXAMPLE 6

Example 4 was repeated, except that the bromide ion content in the green-sensitive emulsion layer was changed to 80 mol %, and the changes in photographic characteristics were assessed using the aged solution in the same way as in Example 4. When the color developing solution according to the invention was used, the increase in fogging was small and good results were obtained.

EXAMPLE 7

A color photographic paper was prepared in the same manner as in Example 3, and after it was subjected to wedge exposure, running processing (continuous processing) test were carried out by using color developing solutions in the following steps until the replenishing amount reached 3 times the tank volume (10 liters).

| Step | Temperature (°C.) | Time (sec) | Replenishing Amount (ml/m$^2$) |
|---|---|---|---|
| Color Developer | 35 | 45 | 160 |
| Bleach-Fix | 35 | 45 | 100 |
| Rinsing (1) | 30 | 20 | |
| Rinsing (2) | 30 | 20 | |
| Rinsing (3) | 30 | 20 | 200 |
| Drying | 60–70 | 30 | |

The rinsing was carried out using a three-tank countercurrent system from rinsing (3) to rinsing (1).

The composition of each processing solution used was as follows:

| Color Developing Solution | Tank Solution | Replenisher |
|---|---|---|
| Additives C and D | See Table 5 | See Table 5 |
| Brightening agent (4,4'-diaminostilbene) | 3.0 g | 4.0 g |
| Ethylenediaminetetraacetic acid | 1.0 g | 1.5 g |
| Potassium carbonate | 30.0 g | 30.0 g |
| Sodium chloride | 1.4 g | 0.1 g |
| 4-Amino-3-methyl-N—ethyl-N—[β-(methanesulfonamido)-ethyl]-p-phenylenediamine sulfate | 5.0 g | 7.0 g |
| Benzyl alcohol | See Table 5 | See Table 5 |
| Diethylene glycol | See Table 5 | See Table 5 |
| 1,2-Dihydroxybenzene-3,4,6-trisulfonic acid | 300 mg | 300 mg |
| Water to make | 1,000 ml | 1,000 ml |
| pH | 10.10 | 10.50 |

| Bleach-Fix Solution (the tank solution was the same as the replenisher) | |
|---|---|
| EDTA Fe(III)$NH_4$.2$H_2O$ | 60 g |
| EDTA.2Na.2$H_2O$ | 4 g |
| Ammonium thiosulfate (70% aq. soln.) | 120 ml |
| Sodium sulfite | 16 g |
| Glacial acetic acid | 7 g |
| Water to make | 1,000 ml |
| pH adjusted using KOH and $H_2SO_4$ to | 5.5 |

The color photographic paper was processed with the above processing solutions in the above steps, and at the start of the running processing and after the completion of the running processing test, the B.G.R. densities (stain) in unexposed portions were measured using a Fuji automatic densitometer. Further, the sample after the completion of running processing was allowed to stand at 80° C. (5 to 10% RH) for 1 month, and the B.G.R. densities in unexposed portions were measured.

The results obtained and the changes in photographic characteristics are given in Table 5.

From the results given in Table 5, it can be seen that in Experiment Nos. 1 and 2, after the running processing, the stains increased greatly, while in Experiment Nos. 3 to 13, the increase in the stains was quite low. Further, in contrast to Experiment Nos. 1 and 2, with respect to the changes with time after the completion of processing in Experiment Nos. 3 to 13, the increase in the stains was very small.

TABLE 5

| Experiment No. | Benzyl Alcohol/ Diethylene Glycol Tank Solution (ml) | Benzyl Alcohol/ Diethylene Glycol Replenishing Solution (ml) | Additive C* (0.04 mol) | Additive D (0.03 mol) | Developing Solution | Increase in Dmin B | Increase in Dmin G | Increase in Dmin R | Dmin after 1 Month at 80° C. B | Dmin after 1 Month at 80° C. G | Dmin after 1 Month at 80° C. R |
|---|---|---|---|---|---|---|---|---|---|---|---|
| 1 | — | — | II-(33) | Triethanol-amine | Comparison | +0.11 | +0.08 | +0.04 | +0.31 | +0.19 | +0.10 |
| 2 | 15/10 | 20/10 | II-(33) | Triethanol-amine | " | +0.13 | +0.10 | +0.05 | +0.32 | +0.21 | +0.10 |
| 3 | — | — | II-(33) | (Ia)-1 | Invention | +0.01 | 0 | 0 | +0.14 | +0.06 | +0.02 |
| 4 | — | — | II-(33) | (Ia)-5 | Invention | +0.01 | +0.01 | 0 | +0.13 | +0.05 | +0.02 |
| 5 | 15/10 | 20/10 | II-(33) | (Ia)-5 | Invention | +0.05 | +0.02 | +0.02 | +0.20 | +0.10 | +0.03 |
| 6 | — | — | II-(5) | (Ia)-1 | Invention | +0.01 | 0 | 0 | +0.10 | +0.04 | +0.01 |
| 7 | — | — | II-(5) | (Ia)-5 | Invention | +0.01 | 0 | 0 | +0.11 | +0.04 | +0.01 |
| 8 | — | — | (a) | (Ia)-1 | Invention | +0.03 | +0.01 | 0 | +0.15 | +0.07 | +0.02 |
| 9 | — | — | (a) | (Ia)-5 | Invention | +0.03 | +0.01 | 0 | +0.14 | +0.07 | +0.01 |
| 10 | — | — | (b) | (Ia)-1 | Invention | +0.03 | +0.01 | 0 | +0.17 | +0.09 | +0.03 |
| 11 | — | — | (b) | (Ia)-5 | Invention | +0.03 | +0.01 | 0 | +0.18 | +0.10 | +0.03 |
| 12 | — | — | (c) | (Ia)-1 | Invention | +0.02 | +0.01 | 0 | +0.12 | +0.06 | +0.01 |
| 13 | — | — | (d) | (Ia)-1 | Invention | +0.04 | +0.02 | 0 | +0.19 | +0.09 | +0.02 |

*Compounds (a), (b), (c) and (d) are the same as those in Table A-(1).

EXAMPLE 8

Using the color photographic paper obtained in Example 4, a running test was performed until the amount of the replenishment of the color developing solution reached 3 times the tank volume (10 liters). The composition of the color developing solution was changed as shown in Table 6. The composition of the remaining processing solutions were the same as the compositions of the processing solutions used in Example 7. The changes in photographic characteristics were measured as in Example 7. The results are shown in Table 6.

TABLE 6

| Experiment No. | Benzyl Alcohol/ Diethylene Glycol Tank Solution (ml) | Benzyl Alcohol/ Diethylene Glycol Replenishing Solution (ml) | Additive C (0.04 mol) | Additive D (0.03 mol) | Developing Solution | Increase in Dmin B | Increase in Dmin G | Increase in Dmin R | Dmin after 1 Month at 80° C. B | Dmin after 1 Month at 80° C. G | Dmin after 1 Month at 80° C. R |
|---|---|---|---|---|---|---|---|---|---|---|---|
| 1 | — | — | II-(33) | Triethanol-amine | Comparison | +0.11 | +0.08 | +0.04 | +0.31 | +0.19 | +0.10 |
| 2 | 15/10 | 20/10 | II-(33) | Triethanol-amine | Comparison | +0.13 | +0.10 | +0.05 | +0.32 | +0.21 | +0.10 |
| 3 | 15/10 | 20/10 | II-(33) | (Ib)-1 | Invention | +0.04 | +0.02 | 0 | +0.20 | +0.12 | +0.04 |
| 4 | 5/5 | 8/5 | II-(33) | (Ib)-1 | Invention | +0.04 | +0.02 | +0.01 | +0.20 | +0.11 | +0.04 |
| 5 | — | — | II-(33) | (Ib)-1 | Invention | +0.01 | +0.01 | 0 | +0.15 | +0.10 | +0.03 |
| 6 | 15/10 | 20/10 | II-(5) | (Ib)-1 | Invention | +0.03 | +0.02 | 0 | +0.18 | +0.12 | +0.04 |
| 7 | — | — | II-(5) | (Ib)-1 | Invention | +0.01 | 0 | 0 | +0.13 | +0.08 | +0.02 |
| 8 | 15/10 | 20/10 | II-(1) | (Ib)-1 | Invention | +0.03 | +0.01 | +0.01 | +0.19 | +0.14 | +0.05 |
| 9 | — | — | II-(1) | (Ib)-1 | Invention | +0.01 | 0 | 0 | +0.13 | +0.09 | +0.03 |
| 10 | — | — | II-(33) | (Ib)-2 | Invention | +0.01 | +0.01 | 0 | +0.15 | +0.11 | +0.03 |
| 11 | — | — | II-(33) | (Ib)-3 | Invention | +0.01 | +0.01 | 0 | +0.15 | +0.10 | +0.04 |
| 12 | — | — | II-(33) | (Ib)-7 | Invention | +0.01 | +0.01 | 0 | +0.16 | +0.11 | +0.03 |
| 13 | — | — | II-(33) | (Ib)-8 | Invention | +0.01 | 0 | 0 | +0.17 | +0.12 | +0.03 |

According to the invention, the increase in Dmin in the course of running processing was lowered, and the increase in the Dmin due to the aging of the processed photographic material was lowered. This effect was further improved when benzyl alcohol was omitted.

EXAMPLE 9

As shown in Table C, a paper the opposite surfaces of which each had been laminated with a polyethylene layer and which had been subjected to corona treatment was coated with the first layer (lowermost layer) to the seventh layer (uppermost layer) to prepare a photographic paper sample. The preparation of each of the coating liquids for the layers is described below, along with the structures of the couplers, the dye stabilizers, and other compounds used in the coating liquids.

The coating liquid for the first layer was prepared as follows. A mixture of 200 g of a yellow coupler, 93.3 g of a fading preventing agent, 10 g of a high boiling point solvent (p), 5 g of a solvent (q) and 600 ml of ethyl acetate as a co-solvent was heated to 60° C. to be dissolved, and then was mixed with 3,300 ml of a 5% aqueous gelatin solution containing 330 ml of a 5% aqueous solution of Alkanol B (trade name for an alkylnaphthalenesulfonate produced by Du Pont). The resulting liquid was emulsified using a colloid mill to prepare a coupler dispersion. The ethyl acetate was removed from the dispersion under reduced pressure, then 1,400 g of an emulsion (containing 96.7 g of Ag and 170 g of gelatin) containing a sensitizing dye for a blue-sensitive emulsion and 1-methyl-2-mercapto-5-acetylamino-1,3,4-triazole was added to the dispersion, and 2,600 g of a 10% aqueous gelatin solution was added to prepare a coating liquid. The coating liquids for the second layer to the seventh layer were prepared in the same manner using the composition shown in Table C.

The cyan couplers shown in Table 7 were used in the fifth layer to prepare photographic papers.

TABLE C

| | |
|---|---|
| Seventh Layer: Protective Layer | |
| Gelatin | 600 mg/m$^2$ |
| Sixth Layer: Ultraviolet Absorbing Layer | |
| Ultraviolet absorbent (n) | 260 mg/m$^2$ |
| Ultraviolet absorbent (o) | 70 mg/m$^2$ |
| Solvent (p) | 300 mg/m$^2$ |
| Solvent (q) | 100 mg/m$^2$ |
| Gelatin | 700 mg/m$^2$ |
| Fifth Layer: Red-Sensitive Layer | |
| Silver chlorobromide emulsion (silver bromide: 1 mol %) | 210 mg/m$^2$ |
| Cyan coupler (see Table 7) | $5 \times 10^{-4}$ mol/m$^2$ |
| Color mixing preventing agent (r) | 250 mg/m$^2$ |
| Solvent (p) | 160 mg/m$^2$ |
| Solvent (q) | 100 mg/m$^2$ |
| Gelatin | 1,800 mg/m$^2$ |
| Fourth Layer: Color Mixing Preventing Layer | |
| Color mixing preventing agent (s) | 65 mg/m$^2$ |
| Ultraviolet absorbent (n) | 450 mg/m$^2$ |
| Ultraviolet absorbent (o) | 230 mg/m$^2$ |
| Solvent (p) | 50 mg/m$^2$ |
| Solvent (q) | 50 mg/m$^2$ |
| Gelatin | 1,700 mg/m$^2$ |
| Third Layer: Green-Sensitive Layer | |
| Silver chlorobromide emulsion (silver bromide: 0.5 mol %) | 305 mg/m$^2$ |
| Magenta coupler | 670 mg/m$^2$ |
| Color fading preventing agent (t) | 150 mg/m$^2$ |
| Color fading preventing agent (u) | 10 mg/m$^2$ |
| Solvent (p) | 200 mg/m$^2$ |
| Solvent (q) | 10 mg/m$^2$ |
| Gelatin | 1,400 mg/m$^2$ |
| Second Layer: Color Mixing Preventing Layer | |
| Silver chlorobromide emulsion (after-ripening was not performed; grain diameter: 0.05 μm) | 10 mg/m$^2$ |
| Color mixing preventing agent (s) | 55 mg/m$^2$ |
| Solvent (p) | 30 mg/m$^2$ |
| Solvent (q) | 15 mg/m$^2$ |
| Gelatin | 800 mg/m$^2$ |
| First Layer: Blue-Sensitive Layer | |
| Silver chlorobromide emulsion (silver bromide: 1 mol %) | 290 mg/m$^2$ |
| Yellow coupler | 600 mg/m$^2$ |

TABLE C-continued

| | |
|---|---|
| Color mixing preventing agent (r) | 280 mg/m$^2$ |
| Solvent (p) | 30 mg/m$^2$ |
| Solvent (q) | 15 mg/m$^2$ |
| Gelatin | 1,800 mg/m$^2$ |

Base:
Paper base the opposite surfaces of which were each laminated with a polyethylene layer
(n): 2-(2-Hydroxy-3,5-di-tert-amylphenyl)benzotriazole
(o): 2-(2-Hydroxy-3,5-di-tert-butylphenyl)benzotriazole
(p): Di(2-ethylhexyl)phthalate
(q): Dibutyl phthalate
(r): 2,5-Di-tert-amylphenyl-3,5-di-tert-butyl-hydroxybenzoate
(s): 2,5-Di-tert-octylhydroquinone
(t): 1,4-Di-tert-amyl-2,5-dioctyloxybenzene
(u): 2,2'-Methylenebis(4-methyl-6-tert-butylphenol)

As sensitizing dyes for the emulsion layers, the following compounds were used:

The blue-sensitive emulsion layer: Anhydro-5-methoxy-5'-methyl-3,3'-disulfopropylselenacyaninehydroxide The green-sensitive emulsion layer: Anhydro-9-ethyl-5,5'-diphenyl-3,3'-disulfoethyloxacarbocyaninehydroxide The red-sensitive emulsion layer: 3,3'-Diethyl-5-methoxy-9,9'-(2,2-dimethyl-1,3-propano)thiadicarbocyanineiodide As the stabilizer of the emulsion layers, the following compound was used:

1-Methyl-2-mercapto-5-acetylamino-1,3,4-triazole

As the irradiation preventing dyes, the following compounds were used:

4-[3-Carboxy-5-hydroxy-4-{3-[3-carboxy-5-oxo-1-(4-sulfonatophenyl)-2-pyrazoline-4-ilidene]-1-propenyl}-1-pyrazolyl]benzenesulfonato-dipotassium salt and N,N'-(4,8-dihydroxy-9,10-dioxo-3,7-disulfonatoanthracene-1,5-diyl)bis(aminomethanesulfonato)tetrasodium salt As a hardening agent, 1,2-bis(binylsulfonyl)ethane was used.

The couplers used were as follows:

Yellow Coupler

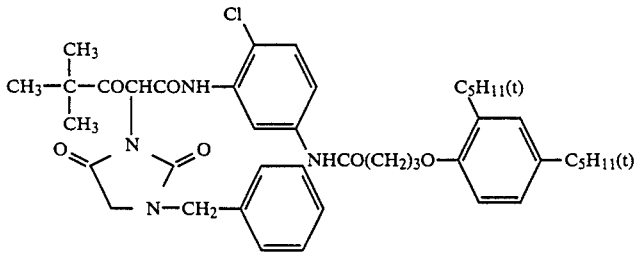

Magenta Coupler

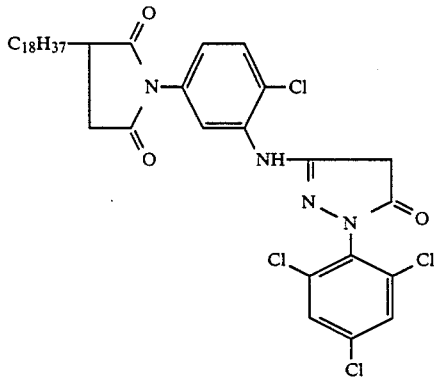

The thus-obtained multilayer color photographic papers were subjected to wedge exposure and were processed in the following processing steps.

| Step | Time | Temperature (°C.) |
|---|---|---|
| Color Development | 3 min 30 sec | 33 |
| Bleach-Fix | 1 min 30 sec | 33 |
| Rinsing (3-tank cascade) | 2 min | 30 |
| Drying | 1 min | 80 |

The processing solutions used were as follows:

| Color Development Solution | |
|---|---|
| Water | 800 m |
| Sodium sulfite | see Table 7 |
| N,N'—Bis(2-hydroxybenzyl)ethylene-diamine-N,N'—diacetic acid | 0.1 g |
| Nitrilo-N,N,N—trimethylenephosphonic acid (40% aq. soln.) | 1.0 g |
| Potassium bromide | 1.0 g |
| Additives C and D | See Table 7 |
| Potassium carbonate | 30 g |
| N—Ethyl-N—(β-methanesulfonamidoethyl)-3-methyl-4-aminoaniline sulfate | 5.5 g |
| Fluorescent brightening agent (4,4'-diaminostilbene) | 1.0 g |
| Water to make | 1,000 ml |
| pH adjusted using KOH to | 10.10 |
| **Bleach-Fix Solution** | |
| Ammonium thiosulfate (70% aq. soln.) | 150 ml |
| Sodium sulfite | 15 g |
| Ethylenediamine iron (III) ammonium salt | 60 g |
| Ethylenediaminetetraacetic acid | 10 g |
| Fluorescent brightening agent (4,4'-diaminostilbene) | 1.0 g |
| 2-Mercapto-5-amino-3,4-thiadiazole | 1.0 g |
| Water to make | 1,000 ml |

-continued

| | |
|---|---|
| pH adjusted using ammonia water to | 7.0 |
| **Rinsing Solution** | |
| 5-Chloro-2-methyl-4-isothiazoline-3-one | 40 mg |
| 2-Methyl-4-isothiazoline-3-one | 10 mg |
| 2-Octyl-4-isothiazoline-3-one | 10 mg |
| Bismuth chloride (40% aq. soln.) | 0.5 g |
| Nitrilo-N,N,N—trimethylenephosphonic acid (40% aq. soln.) | 1.0 g |
| 1-Hydroxyethylidene-1,1-diphosphonic acid (60% aq. soln.) | 2.5 g |
| Fluorescent brightening agent (4,4'-diaminostilbene) | 1.0 g |
| Ammonia water (26% aq. soln.) | 2.0 ml |
| Water to make | 1,000 ml |
| pH adjusted using KOH to | 7.5 |

In the above steps, in the same manner as in Example 3, the fresh solution and an aged solution obtained by allowing a part of the color developing solution to stand for 21 days were used, and gradation and Dmin of the cyan image were measured.

The increase of Dmin and gradation using the aged solution in comparison with the fresh solution are shown in Table 7.

From Table 7, it is seen that in contrast to Experiment Nos. 1 to 3, in Experiment Nos. 4 to 18, even when the developing solution that had been allowed to stand for 21 days was used, the change in Dmin and gradation was small, and therefore that he photographic characteristics were stabilized. It can also be seen, in particular, that when cyan coupler "(C-5)" or "(C-38)" (Experiment Nos. 6, 7, 10, 11, 13, 15, 17 and 18) were used and the sulfite ion concentration in the developing solution was low (Experiment Nos. 10 and 11), the preservability of the developing solution was high and its photographic characteristics were stabilized.

TABLE 7

| Experiment No. | Cyan* Coupler | Sodium Sulfite (g/l) | Additive C (0.04 mol/l) | Additive D (0.03 mol/l) | Developing Solution | Change in Photographic Characteristics Dmin | Gradation |
|---|---|---|---|---|---|---|---|
| 57 | (C-5) | 1.8 | II-(33) | Triethanolamine | Comparison | +0.06 | +0.19 |
| 58 | (C-38) | 1.8 | " | " | " | +0.06 | +0.18 |
| 59 | " | 0 | " | " | " | +0.05 | +0.13 |
| 60 | (A) | 1.8 | " | (Ia)-1 | Invention | +0.03 | +0.05 |
| 61 | (B) | 1.8 | " | " | " | +0.03 | +0.04 |
| 62 | (C-5) | 1.8 | " | " | " | +0.01 | +0.05 |
| 63 | (C-38) | 1.8 | " | " | " | +0.01 | +0.04 |
| 64 | (A) | 0 | " | " | " | +0.02 | +0.02 |
| 65 | (B) | 0 | " | " | " | +0.02 | +0.03 |
| 66 | (C-5) | 0 | " | " | " | 0 | +0.01 |
| 67 | (C-38) | 0 | " | " | " | 0 | +0.01 |
| 68 | (A) | 0 | II-(5) | " | " | +0.03 | +0.02 |
| 69 | (C-38) | 0 | " | " | " | 0 | 0 |
| 70 | (A) | 0 | " | (Ia)-2 | " | +0.02 | +0.02 |
| 71 | (C-38) | 0 | " | " | " | 0 | +0.01 |
| 72 | (A) | 0 | " | (Ia)-5 | " | +0.02 | +0.02 |
| 73 | (C-5) | 0 | " | " | " | 0 | +0.01 |

TABLE 7-continued

| Experiment No. | Cyan* Coupler | Sodium Sulfite (g/l) | Additive C (0.04 mol/l) | Additive D (0.03 mol/l) | Developing Solution | Change in Photographic Characteristics Dmin | Gradation |
|---|---|---|---|---|---|---|---|
| 74 | (C-38) | 0 | " | " | " | 0 | −0.01 |

*Cyan Couplers (A) and (B) are shown below:

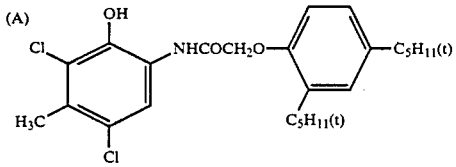

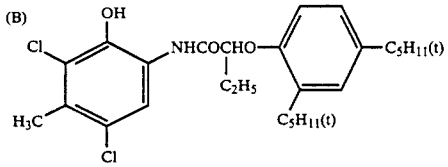

EXAMPLE 10

In the same manner as in Example 9, photographic paper samples were prepared except for changing Additive D, and the increase of Dmin and the gradation using the aged solution over those obtained using the fresh solution were measured to determine the change in photographic characteristics. The results are given in Table 8.

TABLE 8

| Experiment No. | Cyan* Coupler | Sodium Sulfite (g/l) | Additive C (0.04 mol) | Additive D (0.03 mol) | Developing Solution | Change is Photographic Characteristics Dmin | Gradation |
|---|---|---|---|---|---|---|---|
| 1 | (C-5) | 1.8 | II-(33) | Triethanolamine | Comparison | +0.06 | +0.19 |
| 2 | (C-38) | 1.8 | II-(33) | Triethanolamine | Comparison | +0.06 | +0.18 |
| 3 | (C-38) | — | II-(33) | Triethanolamine | Comparison | +0.05 | +0.13 |
| 4 | (A) | 1.8 | II-(33) | (Ib)-1 | Invention | +0.03 | +0.08 |
| 5 | (B) | 1.8 | II-(33) | (Ib)-1 | Invention | +0.03 | +0.09 |
| 6 | (C-5) | 1.8 | II-(33) | (Ib)-1 | Invention | 0 | +0.05 |
| 7 | (C-38) | 1.8 | II-(33) | (Ib)-1 | Invention | 0 | +0.04 |
| 8 | (A) | — | II-(33) | (Ib)-1 | Invention | +0.03 | +0.05 |
| 9 | (B) | — | II-(33) | (Ib)-1 | Invention | +0.02 | +0.05 |
| 10 | (C-5) | — | II-(33) | (Ib)-1 | Invention | 0 | +0.01 |
| 11 | (C-38) | — | II-(33) | (Ib)-1 | Invention | 0 | 0 |
| 12 | (A) | — | II-(5) | (Ib)-1 | Invention | +0.02 | +0.04 |
| 13 | (B) | — | II-(5) | (Ib)-1 | Invention | +0.02 | +0.03 |
| 14 | (C-5) | — | II-(5) | (Ib)-1 | Invention | 0 | +0.01 |
| 15 | (C-38) | — | II-(5) | (Ib)-1 | Invention | 0 | 0 |
| 16 | (C-38) | — | II-(5) | (Ib)-2 | Invention | 0 | +0.01 |
| 17 | (C-38) | — | II-(5) | (Ib)-4 | Invention | +0.01 | +0.01 |
| 18 | (C-38) | — | II-(5) | (Ib)-5 | Invention | 0 | +0.01 |

*Cyan couplers (A) and (B) are the same as those used in Example 9.

When using the developer according to the invention, the change in photographic characteristics when using aged solution is small, and in particular, when cyan couplers represented by (C-I) and (C-II) were used, good results were obtained, i.e., the increase in Dmin was low and the change in gradation was small.

EXAMPLE 11

Example 1 was repeated, except that in Sample Nos. 9 and 12 (instead of Compounds(Ia)-1 and (Ia)-17), Compounds (Ia)-6, (Ia)-8, (Ia)-11, (Ia)-22, (Ia)-24, (Ia)-28, (Ia)-31, (Ia)-33, (Ia)-34, (Ia)-38 and (Ia)-39 were used. As in Example 1, the compounds according to the present invention provided excellent preservability in comparison with the comparative examples.

EXAMPLE 12

Example 10 was repeated, except that Compounds II-(3), II-(6), II-(7), II-(12), II-(16), II-(19) and II-(23) were used. Good results were obtained in the increase in Dmin and the change in gradation.

EXAMPLE 13

A color photographic paper prepared in the same manner as in Example 4, except that the following spectral sensitizers for blue-sensitive, green-sensitive and red-sensitive emulsion layers were used. The papers were imagewise exposed, and subjected to a running processing (continuous processing) test in the same processing steps as those in Example 8, using the same color developing solutions as in Example 8 until the amount of the replenisher became 3 times the tank volume. Spectral sensitizers used:

Spectral sensitizer for blue-sensitive emulsion layer:

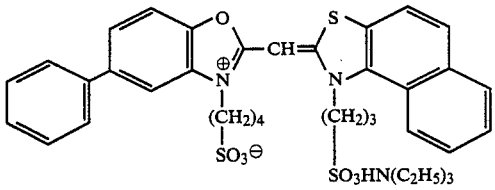

($7\times10^{-4}$ mol was added per mol of silver halide)

Spectral sensitizer for green-sensitive emulsion layer:

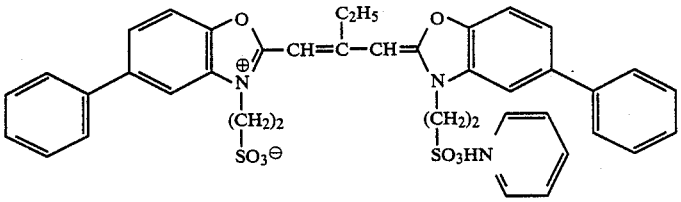

($4\times10^{-4}$ mol was added per mol of silver halide)

Spectral sensitizer for red-sensitive emulsion layer:

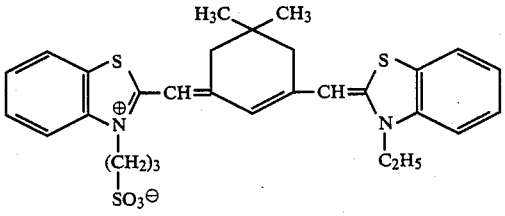

($2\times10^{-4}$ mol was added per mol of silver halide)

As the rinsing liquid, the following washing water was used.

Washing Water

Tap water was passed through a mixed bed chromatographic column loaded with an H-type strong acid cation exchange resin (Diaion SK-IB manufactured by Mitsubishi Chemical Industries Ltd.) and on OH-type strong basic anion exchange resin (Diaion SA-10A manufactured by Mitsubishi Chemical Industries Ltd.) to obtain water having a calcium ion content of 1.1 mg/l, a magnesium ion content of 0.5 mg/l and a pH of 6.9. As a fungicide, sodium dichloroisocyanurate (20 mg/l) was added thereto.

After continuous processing, the same assessment as in Example 8 was carried out, and the same results as in Example 8 were obtained.

These results demonstrate that according to the present invention, the stability and the color forming property of a color developing solution were improved, and that when an aged color developing solution was used, the increase in fogging and change in gradation were greatly reduced, to provide color images with excellent photographic characteristics.

The effect in the present invention was remarkable, particularly in a color developing solution substantially free from benzyl alcohol that is a harmful environmental pollutant.

Further, when a photographic material containing specific cyan couplers was processed, the effect of the present invention was remarkably improved.

Additionally in continuous processing, the increase in fogging was remarkably reduced and the color images obtained were excellent in stability despite the use of aged developer.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising the step of developing a silver halide color photographic material with a developer containing an aromatic primary amine color developing agent and at least one compound represented by the following general formulae (Ia) and (Ib):

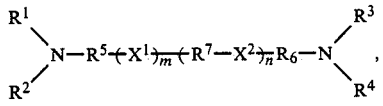

(Ia)

the material being image-wise exposed, wherein $R^1$, $R^2$, $R^3$ and $R^4$, which may be the same or different, each represents a hydrogen atom or an unsubstituted alkyl group; $R^5$, $R^6$ and $R^7$, which may be the same or different, each represents an unsubstituted alkylene group; $X^1$ and $X^2$, which may be the same or different, each represents

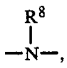

—O—, —S—, —CO—, —$SO_2$ or —SO—, or a combination thereof, and $R^8$ represents a hydrogen atom or an unsubstituted alkyl group; and m and n, which may be the same or different, each is 0, 1, 2 or 3; and

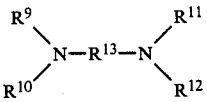

(Ib)

wherein $R^{13}$ represents a substituted alkylene group; and $R^9$, $R^{10}$, $R^{11}$ and $R^{12}$, which may be the same or different, each represents a hydrogen atom, a substituted or unsubstituted alkyl group or a substituted or unsubstituted aryl group wherein said developer further comprises at least one compound capable of directly stabilizing a developing agent, which is selected from the group consisting of a hydroxylamine, a hydrazine, a hydrazide, a hydroxamic acid and an α-hydroxyketone, and wherein said hydroxylamine is represented by the following general formula (II):

$$R^{21}-\underset{\underset{OH}{|}}{N}-R^{22} \quad (II)$$

wherein $R^{21}$ and $R^{22}$, which may be the same or different, each represents a hydrogen atom, a substituted or unsubstituted alkyl group, a substituted or unsubstituted alkenyl group or a substituted or unsubstituted aryl group, provided $R^{21}$ and $R^{22}$ do not represent a hydrogen atom at the same time; and provided that $R^{21}$ and $R^{22}$ may be linked to form a heterocyclic ring including the nitrogen atom of general formula (II).

2. The method as claimed in claim 1, wherein said unsubstituted alkyl group represented by $R^1$, $R^2$, $R^3$, $R^4$ and $R^8$ each contains 1 to 10 carbon atoms; the unsubstituted alkylene groups represented by $R^5$, $R^6$ and $R^7$ each contains 1 to 6 carbon atoms; $X^1$ and $X^2$ each represents $$\overset{\overset{R^8}{|}}{-N-},$$

—O—, or —S—; m and n each represents 0 or 1; $R^{13}$ represents an alkylene group substituted with at least one substituent selected from the group consisting of a hydroxyl group, an alkoxy group, an aryloxy group, an amino group, a sulfo group, a phosphonic acid group, a sulfonyl group, a ureido group, an acyl group, an alkylthio group, an arylthio group, a carbamoyl group, a sulfamoyl group, an acylamino group, a sulfonamido group, a halogen, a cyano group, and a nitro group; and said substituted alkyl group and substituted aryl group represented by $R^9$, $R^{10}$, $R^{11}$ and $R^{12}$ each is substituted with at least one substituent selected from the group consisting of a hydroxyl group, an alkoxy group, an aryloxy group, a carboxyl group, an amino group, a sulfo group, a phosphonic acid group, a sulfonyl group, a ureido group, an acyl group, an alkylthio group, an arylthio group, a carbamoyl group, a sulfamoyl group, an acylamino group, a sulfonamido group, a halogen atom, a cyano group and a nitro group.

3. The method as claimed in claim 2, wherein said unsubstituted alkyl group represented by $R^1$, $R^2$, $R^3$, $R^4$ and $R^8$ contains from 1 to 6 carbon atoms; $X^1$ and $X^2$ each represents $$\overset{\overset{R^8}{|}}{-N-};$$

$R^{13}$ represents an alkylene group substituted with a substituent selected from the group consisting of a hydroxyl group, an alkoxy group, an amino group, a sulfo group, and a ureido group; $R^9$, $R^{10}$, $R^{11}$ and $R^{12}$ each represents a hydrogen atom, an unsubstituted alkyl group, or an alkyl group substituted with a substituent selected from the group consisting of a hydroxyl group, an alkoxy group, a carboxyl group, and a sulfo group; and the total number of carbon atoms contained in $R^9$, $R^{10}$, $R^{11}$, $R^{12}$ and $R^{13}$ is at most 30.

4. The method as claimed in claim 3, wherein the total number of carbon atoms contained in $R^9$, $R^{10}$, $R^{11}$, $R^{12}$ and $R^{13}$ is at most 20.

5. The method as claimed in claim 1, wherein said aromatic primary amine color developing agent comprises a p-phenylenediamine, or a salt thereof selected from a sulfate, a hydrochloride, a sulfite and a p-toluene sulfonate.

6. The method as claimed in claim 1, wherein the total amount of said compound represented by general formulae (Ia) and (Ib) present in said developer is from about 0.05 to 30 g per liter of said developer, and the amount of said aromatic primary amine developing agent is from about 0.01 to about 30 g per liter of said developer.

7. The method as claimed in claim 1, wherein said developer further comprises at least one compound capable of directly stabilizing a developing agent, which is selected from the group consisting of a hydroxylamine, a hydrazine, a hydrazide, a hydroxamic acid and an α-hydroxyketone.

8. The method as claimed in claim 1, wherein $R^{21}$ and $R^{22}$ each represents a substituted or unsubstituted alkyl group or a substituted or unsubstituted alkenyl group.

9. The method as claimed in claim 8, wherein at least one of $R^{21}$ and $R^{22}$ represents a substituted alkyl group or a substituted alkenyl group, wherein the substituent is selected from the group consisting of a halogen atom, an aryl group, an alkoxy group, an aryloxy group, a sulfonyl group, a sulfonamido group, a sulfamoyl group, a carbamoyl group, an amido group, a ureido group, an alkoxycarbonylamino group, an aryloxycarbonylamino group, an alkoxycarbonyl group, an aryloxycarbonyl group, a cyano group, a hydroxyl group, a carboxyl group, a sulfo group, a nitro group, an amino group, an alkylthio group, an arylthio group, and a heterocyclic group.

10. The method as claimed in claim 9, wherein each of $R^{21}$ and $R^{22}$ contains from 1 to 10 carbon atoms, and said substituent is selected from the group consisting of a hydroxyl group, an alkoxy group, a sulfonyl group, an amido group, a carboxyl group, a cyano group, a sulfo group, a nitro group and an amino group.

11. The method as claimed in claim 10, wherein the amount of said compound represented by formula (II) is from about 0.01 to 30 g per liter of said developer.

12. The method as claimed in claim 1, wherein said developer is substantially free from benzyl alcohol.

13. The method as claimed in claim 1, wherein said developer is substantially free from p-aminophenol type developing agent.

14. The method as claimed in claim 1, wherein said developing step is conducted at a temperature of from about 20° to 50° C. for a time of from about 20 seconds to 5 minutes.

15. The method as claimed in claim 1, wherein said silver halide color photographic material comprises a support having thereon at least one silver halide light-sensitive emulsion layer, wherein said silver halide comprises at least about 60 mol % of silver chloride.

16. The method as claimed in claim 1, wherein said silver halide color photographic material comprises a support having thereon at least one silver halide light-sensitive emulsion layer, wherein said silver halide is silver bromide or silver chlorobromide comprising at least about 50 mol % of silver bromide.

17. The method as claimed in claim 1, wherein said silver halide color photographic material comprises at least one cyan coupler represented by the following general formulae (C-I) and (C-II):

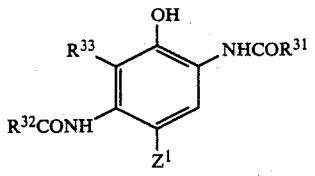

(C-I)

wherein $R^{31}$ represents an alkyl group, a cycloalkyl group, an aryl amino group, an amino group or heterocyclic ring group; $R^{32}$ represents an alkyl group or an aryl group; $R^{33}$ represents a hydrogen atom, a halogen atom, an alkyl group or an alkoxy group; provided that $R^{33}$ may be linked with $R^{32}$ to form a ring; and $Z_1$ represents a hydrogen atom, a halogen atom or a coupling-off group capable of being cleaved by a reaction of said coupler with the oxidation product of an aromatic primary amine color developing agent; and

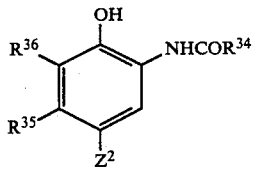

(C-II)

wherein $R^{34}$ represents an alkyl group, acycloalkyl group, an aryl group or a heterocyclic group; $R^{35}$ represents an alkyl group having at least 2 carbon atoms; $R^{36}$ represents a hydrogen atom, a halogen atom or an alkyl group; and $Z^2$ represents a hydrogen atom, a halogen atom or a coupling-off group capable of being cleaved by a reaction of said coupler with the oxidation product of an aromatic primary amine color developing agent.

18. A color developer composition comprising an aromatic primary amine color developing agent and at least one compound represented by the following general formulae (Ia) and (Ib):

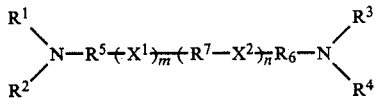

(Ia)

wherein $R^1$, $R^2$, $R^3$ and $R^4$, which may be the same or different, each represents a hydrogen atom or an unsubstituted alkyl group; $R^5$, $R^6$ and $R^7$, which may be the same or different, each represents an unsubstituted alkylene group; $X^1$ and $X^2$, which may be the same or different, each represents

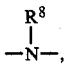

—O—, —S—, —CO—, $—SO_2$ or —SO—, or a combination thereof, and $R^8$ represents a hydrogen atom or an unsubstituted alkyl group; and m and n, which may be the same or different, each is 0, 1, 2 or 3; and

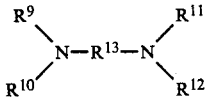

(Ib)

wherein $R^{13}$ represents a substituted alkylene group; and $R^9$, $R^{10}$, $R^{11}$ and $R^{12}$, which may be the same or different, each represents a hydrogen atom, a substituted or unsubstituted alkyl group or a substituted or unsubstituted aryl group wherein said developer further comprises at least one compound capable of directly stabilizing a developing agent, which is selected from the group consisting of a hydroxylamine, a hydrazine, a hydrazide, a hydroxamic acid and an α-hydroxyketone, and wherein said hydroxylamine is represented by the following general formula (II):

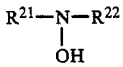

(II)

wherein $R^{21}$ and $R^{22}$ which may be the same or different, each represents a hydrogen atom, a substituted or unsubstituted alkyl group, a substituted or unsubstituted alkenyl group or a substituted or unsubstituted aryl group, provided $R^{21}$ and $R^{22}$ do not represent a hydrogen atom at the same time; and provided that $R^{21}$ and $R^{22}$ may be linked to form a heterocyclic ring including the nitrogen atom of general formula (II).

19. A color developing composition comprising an aromatic primary amine color developing agent and at least one compound represented by the following general formula (Ia):

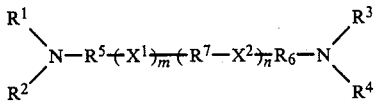

(Ia)

wherein $R^1$, $R^2$, $R^3$ and $R^4$, which may be the same or different, each represents a hydrogen atom or an unsubstituted alkyl group; $R^5$, $R^6$ and $R^7$, which may be the same or different, each represents an unsubstituted alkylene group; $X^1$ and $X^2$, which may be the same or different, each represents

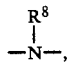

—O—, —S—, —CO—, $—SO_2$ or —SO—, or a combination thereof, and $R^8$ represents a hydrogen atom or an unsubstituted alkyl group; and m and n, which may be the same or different, each is 0, 1, 2 or 3 wherein said developer further comprises at least one compound capable of directly stabilizing a developing agent, which is selected from the group consisting of a hydroxylamine, a hydrazine, a hydrazide, a hydroxamic acid and an α- hydroxyketone, and wherein said hydroxylamine is represented by the following general formula (II):

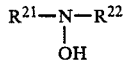

(II)

wherein $R^{21}$ and $R^{22}$, which may be the same or different, each represents a hydrogen atom, a substituted or unsubstituted alkyl group, a substituted or unsubstituted alkenyl group or a substituted or unsubstituted aryl group; provided $R^{21}$ and $R^{22}$ do not represent a hydrogen atom at the same time; provided that $R^{21}$ and $R^{22}$ may be linked to form a heterocyclic ring including the nitrogen atom of general formula (II).

20. A color developing composition comprising an aromatic primary amine color developing agent and at least one compound represented by the following formula (Ib):

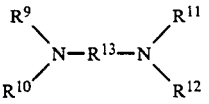

(Ib)

wherein $R^{13}$ represents a substituted alkylene group; and $R^9$, $R^{10}$, $R^{11}$ and $R^{12}$, which may be the same or different, each represents a hydrogen atom, a substituted or unsubstituted alkyl group or a substituted or unsubstituted aryl group wherein said developer further comprises at least one compound capable of directly stabilizing a developing agent, which is selected from the group consisting of a hydroxylamine, a hydrazine, hydrazide, a hydroxamic acid and an α-hydroxyketone, and wherein said hydroxylamine is represented by the following general formula (II):

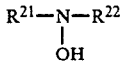

(II)

wherein $R^{21}$ and $R^{22}$, which may be the same or different, each represents a hydrogen atom, a substituted or unsubstituted alkyl group, a substituted or unsubstituted alkenyl group or a substituted or unsubstituted aryl group; provided $R^{21}$ an $R^{22}$ do not represent a hydrogen atom at the same time; and provided that $R^{21}$ and $R^{22}$ may be linked to form a heterocyclic ring including the nitrogen atom of general formula (II).

21. The color developing composition as claimed in claim 18, wherein said unsubstituted alkyl group represented by $R^1$, $R^2$, $R^3$, $R^4$ and $R^8$ each contains 1 to 10 carbon atoms; the unsubstituted alkylene groups represented by $R^5$, $R^6$ and $R^7$ each contains 1 to 6 carbon atoms; $X^1$ and $X^2$ each represents

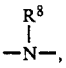

—O—, or —S—; m and n each represents 0 or 1; $R^{13}$ represents an alkylene group substituted with at least one substituent selected from the group consisting of a hydroxyl group, an alkoxy group, an aryloxy group, an amino group, a sulfo group, a phosphonic acid group, a sulfonyl group, a ureido group, an acyl group, an alkylthio group, an arylthio group, a carbamoyl group, a sulfamoyl group, an acylamino group, a sulfonamido group, a halogen, a cyano group, and a nitro group; and said substituted alkyl group and substituted aryl group represented by $R^9$, $R^{10}$, $R^{11}$ and $R^{12}$ each is substituted with at least one substituent selected from the group consisting of a hydroxyl group, an alkoxy group, an aryloxy group, a carboxyl group, an amino group, a sulfo group, a phosphonic acid group, a sulfonyl group, a ureido group, an acyl group, an alkylthio group, an arylthio group, a carbamoyl group, a sulfamoyl group, an acylamino group, a sulfonamido group,, a halogen atom, a cyano group and a nitro group.

22. The color developing composition as claimed in claim 21, wherein said unsubstituted alkyl group represented by $R^1$, $R^2$, $R^3$, $R^4$ and $R^8$ each contains from 1 to 6 carbon atoms; $X^1$ and $X^2$ each represents

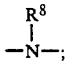

$R^{13}$ represents an alkylene group substituted with a substituent selected from the group consisting of a hydroxyl group, an alkoxy group, an amino group, a sulfo group, and a ureido group; $R^9$, $R^{10}$, $R^{11}$ and $R^{12}$ each represents a hydrogen atom, an unsubstituted alkyl group, or an alkyl group substituted with a substituent selected from the group consisting of a hydroxyl group, an alkoxy group, a carboxyl group, and a sulfo group; and the total number of carbon atoms contained in $R^9$, $R^{10}$, $R^{11}$, $R^{12}$ and $R^{13}$ is at most 30.

23. The color developing composition as claimed in claim 21, wherein the total number of carbon atoms contained in $R^9$, $R^{10}$, $R^{11}$, $R^{12}$ and $R^{13}$ is at most 20.

24. The color developing composition as claimed in claim 18, wherein said aromatic primary amine color developing agent comprises a p-phenylenediamine, or a salt thereof selected from a sulfate, a hydrochloride, a sulfite and a p-toluene sulfonate.

25. The color developing composition as claimed in claim 18, wherein said developer is substantially free from p-aminophenol type developing agent.

26. The color developing composition as claimed in claim 18, wherein the amount of said compound represented by general formula (Ia) or (Ib) present in said developer is from about 0.05 to 30 g per liter of said developer, and the amount of said aromatic primary amine developing agent is from about 0.01 to about 130 g per liter of said developer.

* * * * *